US006642663B2

(12) United States Patent
Okamura et al.

(10) Patent No.: US 6,642,663 B2
(45) Date of Patent: Nov. 4, 2003

(54) METHOD AND CIRCUIT FOR DRIVING PLASMA DISPLAY PANEL, AND PLASMA DISPLAY DEVICE

(75) Inventors: Teruo Okamura, Tokyo (JP); Hiroshi Shirasawa, Tokyo (JP); Mitsuhiro Ishizuka, Tokyo (JP); Takatoshi Shoji, Tokyo (JP)

(73) Assignee: NEC Corporation, Tokyo (JP)

( * ) Notice: Subject to any disclaimer, the term of this patent is extended or adjusted under 35 U.S.C. 154(b) by 7 days.

(21) Appl. No.: 10/003,346

(22) Filed: Dec. 6, 2001

(65) Prior Publication Data

US 2002/0067136 A1 Jun. 6, 2002

(30) Foreign Application Priority Data

Dec. 6, 2000 (JP) ..... 2000-372118

(51) Int. Cl.[7] ..... G09G 3/10
(52) U.S. Cl. ..... 315/169.3; 315/169.1
(58) Field of Search ..... 315/169.3, 169.1, 315/169.4, 169.2; 345/63, 68, 77, 204, 208, 60; 340/771, 805

(56) References Cited

U.S. PATENT DOCUMENTS 4,594,588 A * 6/1986 Barclay et al. ..... 340/771
6,249,087 B1 * 6/2001 Takayama et al. ..... 315/169.1
6,456,263 B1 * 9/2002 Hashimoto et al. ..... 345/60
6,483,248 B2 * 11/2002 Nagakubo et al. ..... 315/169.3

FOREIGN PATENT DOCUMENTS

| | | |
|---|---|---|
| JP | 2823126 | 9/1998 |
| JP | 11-65518 | 3/1999 |
| JP | 11-202831 | 7/1999 |
| JP | 3036496 | 2/2000 |

* cited by examiner

*Primary Examiner*—James Clinger
(74) *Attorney, Agent, or Firm*—Sughrue Mion, PLLC

(57) ABSTRACT

A method and circuit for driving a plasma display panel are provided which are capable of preventing a useless display, irrespective of characteristics of a driving power source. In the method for driving the disclosed plasma display panel, a pulse having an erasing pulse which causes a maximum potential difference between sustaining electrodes being adjacent to each other to reach at least sustaining voltage is applied, immediately after power is applied, to a scanning electrode.

18 Claims, 19 Drawing Sheets

METHOD AND CIRCUIT FOR DRIVING PLASMA DISPLAY PANEL, AND PLASMA DISPLAY DEVICE

BACKGROUND OF THE INVENTION

1. Field of the Invention

The present invention relates to a method for driving a plasma display panel (PDP) used as a flat plasma display device such as a television, computer or a like, its driving circuit and a plasma display device having the driving circuit and more particularly to the method for an alternating current (AC) driving surface-discharge type plasma display, its driving circuit and the plasma display device provided with the driving circuit of such plasma display.

The present application claims priority of Japanese Patent Application No. 2000-372118 filed on Dec. 6,2000, which is hereby incorporated by reference.

2. Description of the Related Art

FIG. 14 is a schematic exploded perspective view showing configurations of a conventional AC driving surface-discharge type PDP 1 disclosed in, for examples Japanese Patent No. 3036496 or Japanese Laid-open Patent Application No. Hei 11-202831. FIG. 15 is an enlarged cross-sectional view showing one display cell of the conventional PDP 1. The display cell is a minimum unit making up a display screen. It should be noted that FIG. 15 shows a view obtained by cutting the PDP 1 illustrated in FIG. 14 in a longitudinal direction with its components being not resolved and obtained by viewing its right cross section.

In the PDP 1 shown in FIGS. 14 and 15, a plurality of stripe-shaped scanning electrodes 3 ($\mathbf{3}_1$–$\mathbf{3}_n$) (may hereinafter referred to as the scanning electrode 3 ($\mathbf{3}_1$–$\mathbf{3}_n$)) and stripe-shaped sustaining electrodes $\mathbf{4}_1$–$\mathbf{4}_n$ may hereinafter referred to as the sustaining electrode 4 ($\mathbf{4}_1$–$\mathbf{4}_n$)) each being constructed of a transparent conductive thin film made of Indium Tin Oxide (ITO), tin oxide or a like, is formed at established intervals alternately on an under surface of a front insulating substrate 2 made of glass in a row direction (in a right to left direction in FIG. 14) and, in order to decrease a resistance value of the scanning electrode 3 ($\mathbf{3}_1$–$\mathbf{3}_n$) and sustaining electrode 4 ($\mathbf{4}_1$–$\mathbf{4}_n$) each having low conductivity, a plurality of trace electrodes 5 and 6 each being made up of a metal film such as a silver thick film or a like is formed on end side of an under surface of the scanning electrode 3 ($\mathbf{3}_1$–$\mathbf{3}_n$) and the sustaining electrode 4 ($\mathbf{4}_1$–$\mathbf{4}_n$) The under surface of the scanning electrode 3 ($\mathbf{3}_1$–$\mathbf{3}_n$) and the sustaining electrode 4 ($\mathbf{4}_1$–$\mathbf{4}_n$) and an under surface of the front insulating substrate 2 on which the scanning electrodes 3 and the sustaining electrode 4 ($\mathbf{4}_1$–$\mathbf{4}_n$) are not formed, is coated with a transparent dielectric layer 7 and an under surface of the dielectric layer 7 is coated with a protection layer 8 made from magnesium oxide which is used to protect the dielectric layer 7 from ion bombardment at a time of discharging.

On the other hand, a plurality of stripe-formed data electrodes $\mathbf{10}_1$–$\mathbf{10}_m$(may hereinafter referred to as the data electrode 10 ($\mathbf{10}_1$–$\mathbf{10}_m$)) made up of silver films or a like is formed on an upper surface of a rear insulating substrate 9 made from glass in a column direction (in a left to right direction in FIG. 14), that is, in a direction orthogonal to a direction in which the scanning electrode 3 ($\mathbf{3}_1$–$\mathbf{3}_n$) and the sustaining electrode 4 ($\mathbf{4}_1$–$\mathbf{4}_n$) are formed and an upper surface of the data electrode 10 ($\mathbf{10}_1$–$\mathbf{10}_m$) and the upper surface of the rear insulating substrate 9 on which the data electrode 10 ($\mathbf{10}_1$–$\mathbf{10}_m$) are not formed is coated with a dielectric layer 11. Moreover, stripe-shaped ribs (partitioning walls) 12 (hereinafter referred to as the rib 12) used to partition the display cell are formed on an upper surface of the dielectric layer 11 except an upper portion of the data electrode 10 ($\mathbf{10}_1$–$\mathbf{10}_m$) and three kinds of fluorescent layers $\mathbf{13}_R$, $\mathbf{13}_G$, and $\mathbf{13}_B$ each converting ultra-violet rays produced by discharge of discharging gas into visible light having three primary colors including a red (R) color, green (G) color, and blue (B) color are formed on the upper surface of the di electric layer 11 existing in an upper portion of the data electrode 10 ($\mathbf{10}_1$–$\mathbf{10}_m$) and on sides of the rib 12. The fluorescent layers $13_R$, $\mathbf{13}_G$, and $\mathbf{13}_B$ are formed in order of the fluorescent layer $\mathbf{13}_R$, fluorescent layer $\mathbf{13}_G$ and fluorescent layer 13, in a row direction sequentially and repeatedly, and fluorescent layers $\mathbf{13}_R$, $\mathbf{13}_G$, and $\mathbf{13}_B$ used to convert ultra-violet rays into visible light having a same color are formed successively in a column direction. A discharging gas space 14 is secured which is formed by an under surface of the protection layer 8, by an upper surface of each of the fluorescent layers $\mathbf{13}_R$, $\mathbf{13}_G$, and $\mathbf{13}_B$, and by side walls of two ribs 12 being adjacent to each other. The discharging gas space 14 is filled with a discharging gas containing helium, neon or xenon or its mixed gas. A region made up of the scanning electrode 3 ($\mathbf{3}_1$–$\mathbf{3}_n$), the sustaining electrode 4 ($\mathbf{4}_1$–$\mathbf{4}_n$), the trace electrodes 5 and 6, the data electrode 10 ($\mathbf{10}_1$–$\mathbf{10}_m$), the fluorescent layer $\mathbf{13}_R$, $\mathbf{13}_G$, and $\mathbf{13}_B$, and the discharging gas space 14 serves as the display cell described above.

FIG. 16 is a schematic block diagram showing an example of configurations of a driving circuit of the conventional AC driving surface-discharge type PDP 1 of FIG. 14. In the PDP 1 shown in FIG. 16, n pieces ("n" is a natural number) of the scanning electrodes $\mathbf{3}_1$ to $\mathbf{3}_n$ and n pieces ("n" is a natural number) of the sustaining electrodes $\mathbf{4}_1$ to $\mathbf{4}_n$ are formed at established intervals in a row direction and m pieces ("m" is a natural number) of the data electrodes $\mathbf{10}_1$ to $\mathbf{10}_m$ are formed at established intervals in a column direction and the number of the display cells on an entire display screen is (n×m) pieces.

The driving circuit of the PDP 1, as shown in FIG. 16, chiefly includes a driving power source 21, a controller 22, a scanning driver 23, a scanning pulse driver 24, a sustaining driver 25, and a data driver 26. The driving power source 21 produces a logic voltage $V_{dd}$ of 5 Volts and, at a same time, a data voltage $V_d$ of about 70 Volts, and a sustaining voltage $V_s$ of about 180 Volts and also generates, based on the sustaining voltage $V_s$, a priming voltage $V_P$ of about 400 Volts, a scanning base voltage $V_{bW}$ of about 100 Volts and a bias voltage $V_{sw}$ of about 195 Volts, and feeds the logic voltage $V_{dd}$ to the controller 22, the data voltage $V_d$ to the data driver 26, the sustaining voltage $V_s$ to the scanning driver 23 and the sustaining driver 25, the priming voltage $V_P$ and scanning base voltage $V_{bw}$ to the scanning driver 23 and the bias voltage $V_{sw}$ to the sustaining driver 25.

The controller 22 produces, based on a video signal $S_v$ fed from an outside, scanning driver control signals $S_{SCD1}$ to $S_{SCD6}$, scanning pulse driver control signals $S_{SPD11}$ to $S_{SPDin}$ and $S_{SPD21}$ to $S_{SPD2n}$, sustaining driver control signals $S_{SUD1}$ to $S_{SUD3}$, data driver control signals $S_{DD11}$ to $S_{DD1m}$ and $S_{DD21}$ to $S_{DD2m}$ and then feeds the scanning driver control signals $S_{SCD1}$ to $S_{SCD6}$ to the scanning driver 23, the scanning pulse driver control signals $S_{SPD11}$ to $S_{SPD1n}$ and $S_{SPD21}$ to $S_{SPD2}$ to the scanning pulse driver 24, the sustaining driver control signals $S_{SUD1}$, to $S_{SUD3}$ to the sustaining driver 25, the data driver control signals $S_{DD11}$ to $S_{DD1m}$ and $S_{DD21}$ to $S_{DD2m}$ to the data driver 26.

The scanning driver 23, as shown in FIG. 17, includes switches $\mathbf{23}_1$ to $\mathbf{23}_6$. One terminal of the switch $\mathbf{23}_1$ is supplied with the priming voltage $V_p$ and the other terminal of the switch $23_1$ is connected to a positive line 27. One terminal of the switch $23_2$ is supplied with the sustaining voltage $V_s$ and the other terminal of the switch $23_2$ is connected to the positive line 27. One terminal of the switch $23_3$ is connected to a negative line 28 and the other terminal of the switch $23_3$ is connected to a ground. One terminal of the switch $23_4$ is supplied with the scanning base voltage $V_{bW}$ and the other terminal of the switch $23_4$ is connected to the negative line 28. One terminal of the switch $23_5$ is connected to the positive line 27 and the other terminal of the switch $23_5$ is connected to a ground. One terminal of the switch $23_6$ is connected to the negative line 28 and the other terminal of the switch $23_6$ is connected to a ground. Each of the switches $23_1$ to $23_6$ is turned ON/OFF, based on the scanning driver control signals $S_{SCD1}$ to $S_{SCD6}$, and applies voltages each having a predetermined waveform through the positive line 27 and negative line 28 to the scanning pulse driver 24.

The scanning pulse driver 24, as shown in FIG. 17, includes n pieces of switches $24_{11}$ to $24_{1n}$, n pieces of switches $24_{21}$ to $24_{2n}$, n pieces of diodes $24_{31}$ to $24_{3n}$ and n pieces of diodes $24_{41}$ to $24_{4n}$. Each of the diodes $24_{31}$ to $24_{3n}$ is connected in parallel to both ends of each of corresponding switches $24_{11}$ to $24_{1n}$. Each of the diodes $24_{41}$ to $24_{4n}$ is connected in parallel to both ends of each of corresponding switches $24_{21}$ to $24_{2n}$. The switch $24_{11}$ is daisy-chained to the switch $24_{21}$. The switch $24_{12}$ is daisy-chained to the switch $24_{22}$. The switch $24_{13}$ is daisy-chained to the switch $24_{23}$. Similarly, the switch $24_{1n}$ is daisy-chained to the switch $24_{2n}$. The switches $24_{11}$ to $24_{1n}$ are connected to the negative line 28 with all of one terminal of each of the switches $24_{11}$ to $24_{1n}$ being connected to each other and the switches $24_{21}$ to $24_{2n}$ are connected to the positive line 27 with all of one terminal of each of the switches $24_{21}$ to $24_{2n}$ being connected to each other. Moreover, a connecting point between the switch $24_{11}$ and the switch $24_{21}$ is connected to a first scanning electrode $3_1$ of scanning electrodes 3 ($3_1$–$3_n$) Of the PDP 1 (as shown in FIG. 14). As shown in FIGS. 16 and 17, a connecting point between the switch $24_{12}$ and the switch $24_{22}$ is connected to a second scanning electrode $3_2$ of scanning electrodes 3($3_1$–$3_n$). A connecting point between the switch $24_{13}$ and the switch $24_{23}$ is connected to a third scanning electrode $3_3$ of scanning electrodes 3($3_1$–$3_n$). Similarly, a connecting point between the switch $24_{1n}$ and the switch $24_{2n}$ is connected to an n-th scanning electrode $3_n$. Each of the switches $24_{11}$ to $24_{1n}$ is turned ON/OFF in response to each of the scanning pulse control signals $S_{SPD11}$ to $S_{SPD1n}$ to be fed from the controller 22. Each of the switches $24_{31}$ to $24_{3n}$ is turned ON/OFF in response to each of the scanning pulse control signals $S_{SPD21}$ to $S_{SPDn}$ to be fed from the controller 22. Then, each of the switches $24_{11}$ to $24_{1n}$ and the switches $24_{21}$ to $24_{2n}$ feeds each of the pulses $P_{SC1}$ to $P_{SCn}$ each having a predetermined waveform sequentially to each of the scanning electrodes $3_1$ to $3_n$ of the PDP 1.

The sustaining driver 25, as shown in FIG. 18, is made up of three pieces of switches $25_1$ to $25_3$. One terminal of the switch $25_1$ is supplied with the sustaining voltage $V_s$ and another terminal of the switch $25_1$ is connected to all the sustaining electrodes $4_1$ to $4_n$ of the PDP 1. One terminal of the switch $25_2$ is connected to all the sustaining electrodes $4_1$ to $4_n$ of the PDP 1 and another terminal of the switch $25_2$ is connected to a ground. One terminal of the switch $25_3$ is supplied with the bias voltage $V_{sw}$ and another terminal of the switch $25_3$ is connected to all the sustaining electrodes $4_1$ to $4_n$. Each of the switches $25_1$ to $25_3$ is turned ON/OFF in response to the sustaining driver control signals $S_{SUD1}$ to $S_{SUD3}$ and feeds a sustaining pulse $P_{SU}$ having a predetermines waveform to all the sustaining electrodes $4_1$ to $4_n$ (shown in FIG. 16)of the PDP 1 in response to each of the sustaining driver control signals $S_{SUD1}$ to $S_{SUD3}$.

The data driver 26, as shown in FIG. 19, includes m pieces of switches $26_{11}$ to $26_{1m}$, m pieces of switches $26_{21}$ to $26_{2m}$, m pieces of diodes $26_{31}$ to $26_{3m}$ and m pieces of diodes $26_{41}$ to $26_{4m}$. Each of the diodes $26_{31}$ to $26_{3m}$ is connected in parallel to both ends of each of corresponding switches $26_{11}$ to $26_{1m}$. Each of the diodes $26_{41}$ to $24_{4m}$ is connected in parallel to both ends of each of corresponding switches $26_{21}$ to $26_{2m}$. The switch $26_{11}$ is daisy-chained to the switch $26_{21}$. The switch $26_{12}$ (not shown) is daisy-chained to the switch $26_{22}$ (not shown). The switch $26_{13}$ (not shown) is daisy-chained to the switch $26_{23}$. The switch $26_{1m}$ is daisy-chained to the switch $26_{2m}$. The switches $26_{11}$ to $26_{1m}$ are connected to a ground with all of one terminal of each $26_{11}$ to $26_{1m}$ being connected to each other and the switches $26_{21}$ to $26_{2m}$ are supplied with the data voltage $V_d$ with all of one terminal of each of the switches $26_{2l}$ to $26_{1m}$ being connected to each other. Moreover, a connecting point between the switch $26_{11}$ and the switch $26_{21}$ is connected to a first data electrode $10_1$ (FIG. 16) of data electrodes 10 ($10_1$–$10_m$) of the PDP 1. A connecting point between the switch $26_{12}$ and the switch $26_{22}$ is connected to a second data electrode $10_2$ of data electrodes 10 ($10_1$–$10_m$). A connecting point between the switch $26_{13}$ and the switch $26_{23}$ is connected to a third data electrode $10_3$ of data electrodes 10 ($10_1$–$10_m$). Similarly, a connecting point between the switch $26_{1m}$ and the switch $26_{2m}$ is connected to the mth data electrode $10_m$ (FIG. 16) of data electrodes 10 ($10_1$–$10_m$). Each of the switches $26_{11}$ to $26_{1m}$ is turned ON/OFF in response to each of the data driver control signals $S_{DD11}$ to $S_{DD1m}$ to be fed from the controller 22. Each of the switches $26_{21}$ to $26_{2m}$ is turned ON/OFF in response to each of the data driver control signals $S_{DD21}$ to $S_{DD2m}$ to be fed from the controller 22 (FIG. 16). Then, each of the switches $26_{11}$ to $26_{1m}$ and the switches $26_{21}$ to $26_{2m}$ feeds each of the pulses $P_{D1}$ to $P_{Dm}$ each having a predetermined waveform sequentially to each of the data electrodes $10_1$ to $10_m$ of the PDP 1. Each of the above switches $23_1$ to $23_6$, $24_{11}$, to $24_{1m}$ $24_{21}$ to $24_{2m}$, $25_1$ to $25_3$, $26_{11}$ to $26_{1m}$ and $26_{21}$ to $26_{2m}$ is turned ON while the fed control signal is high and OFF while the fed control signal is low. Instead of these switches, not only physical switches but also switching elements such as a bipolar transistor, field effect transistor or a like can be used.

Next, operations performed immediately after a supply of power-ON the driving circuit of the PDP 1 will be described by referring to a timing chart shown in FIG. 20. In the PDP 1, since luminance of each color of light emitted by each of the display cells is proportional to the number of light emitting pulses, gray-scale display can be produced by changing the number of light emitting pulses in one frame period during which a frame F making up one screen is displayed. To achieve this, one period for the frame F is so configured as to be made up of a plurality of subfield periods SF and binary images are displayed during each of the subfield periods SF and a weight is assigned to light emitting time of each of the display cells for every subfield period SF. Such the method for producing the gray-scale display is called a "subfield method". FIG. 20 shows a waveform of each of signals fed during a first subfield period SF immediately after the supply of power. However, amplitudes of the pulse Psck (k is a natural number and $1 \leqq k \leqq n$), shown in (1) in FIG. 20, to be fed to a scanning side and the sustaining pulse $P_{SU}$ fed to the scanning side shown in (2) in FIG. 20 are determined in a relative manner and, since states of these signals are ones obtained immediately after the power-ON, voltage values of the sustaining voltage $V_s$, priming voltage $V_p$, and bias voltage $V_{sw}$ are transitory ones which have not yet reached predetermined values. The above subfield period SF includes a priming period $T_p$ which is a period required for causing feeble discharge to occur in order to reduce an amount of wall charges being deposited on both the scanning electrode 3 ($\mathbf{3}_1$–$\mathbf{3}_n$) and sustaining electrode 4 ($\mathbf{4}_1$–$\mathbf{4}_n$) (FIG. 14) after priming discharge has occurred, an address period $T_A$ which is a period required for selecting the display cell used for light emitting, a sustaining period $T_s$ which is a period required for causing the selected display cell to emit light, an electric charge erasing period $T_E$ which is a period required for erasing wall charges being deposited on the scanning electrode 3 ($\mathbf{3}_1$–$\mathbf{3}_n$) and sustaining electrode 4 ($\mathbf{4}_1$–$\mathbf{4}_n$) of the selected display cell during the sustaining period $T_s$.

As shown in FIG. 16, when power is turned ON, the driving power source 21 first starts feeding the logic voltage $V_{dd}$ to the controller 22. Then, as shown in FIG. 20, the controller 22, after having initialized its internal circuits, produces, based on the video signal $S_v$ to be fed from an outside, the scanning driver control signals $S_{SCD1}$ to $S_{SCD6}$ shown in (3) to (8) in FIG. 20, the sustaining driver control signals $S_{SUD1}$ to $S_{SU3}$ shown in (9) to (11) in FIG. 20, the scanning pulse driver control signals $S_{SPD11}$ to $S_{SPD2n}$ shown in (12) to (17) in FIG. 20, the high-level data driver control signals $S_{DD11}$ to $S_{DD1m}$ (not shown) used to cause a black color to be displayed on the entire PDP 1 and the low-level data driver control signals $S_{DD21}$ to $S_{DD2m}$ (not shown) used also to cause the black color to be displayed on the entire of the PDP 1 and then starts feeding each of the corresponding control signals to each of the scanning driver 23, sustaining driver 25, scanning pulse driver 24, and data driver 26.

Next, the driving power source 21, when a few hundred milliseconds have elapsed after having started feeding the logic voltage $V_{dd}$ to the controller 22, begins feeding the sustaining voltage $V_s$, priming voltage $V_p$, scanning base voltage $V_{bw}$, bias voltage $V_{sw}$ and data voltage $V_d$ to each of the scanning driver 23, sustaining driver 25 and data driver 26. As a result, during the priming period $T_p$, since the switch $\mathbf{23}_1$ of the scanning driver 23 is turned ON (see FIG. 17) in response to the scanning driver control signal $S_{SCD1}$ (see (3) in FIG. 20) and the switch $\mathbf{25}_2$ of the sustaining driver 25 is turned ON (see FIG. 18) in response to the high-level sustaining driver control signal $S_{SUD2}$ (see (10) in FIG. 20), a priming pulse $P_{PRP}$ of positive polarity is applied to all scanning electrodes $\mathbf{3}_1$ to $\mathbf{3}_n$ and a priming pulse $P_{PRN}$ of negative polarity (see (2) in FIG. 20) is applied to all sustaining electrodes $\mathbf{4}_1$ to $\mathbf{4}_n$ (FIG. 15). Therefore, the priming discharge occurs in the discharging gas space 14 (FIG. 15) in the vicinity of a gap between the scanning electrodes $\mathbf{3}_1$ to $\mathbf{3}_n$ and the sustaining electrodes $\mathbf{4}_1$ to $\mathbf{4}_n$, which causes active particles inducing easy occurrence of discharging in the display cell to be produced and causes wall charges of negative polarity to be accumulated on the scanning electrodes $\mathbf{3}_1$ to $\mathbf{3}_n$ and wall charges of positive polarity to be also accumulated on the sustaining electrodes $\mathbf{4}_1$ to $\mathbf{4}_n$.

Then, when the sustaining driver control signal $S_{SUD2}$ (see (10) in FIG. 20) becomes a high to a low, the switch $\mathbf{25}_2$ of the sustaining driver 25 is turned OFF and when the sustaining driver control signal $S_{SUD1}$ (see (9) in FIG. 20) becomes a low to a high, the switch $\mathbf{25}_1$ of the sustaining driver 25 is turned ON (see FIG. 18). Then, since the switch $\mathbf{23}_3$ of the scanning driver 23 is turned ON (see FIG. 17) in response to the high-level scanning driver control signal $S_{SCD3}$ (see (5) in FIG. 20), after the voltage of all the sustaining electrodes $\mathbf{4}_1$ to $\mathbf{4}_n$ is maintained at about 180 Volts, a first charge erasing pulse $P_{EEN1}$ (see (1) in FIG. 20) is applied to all the scanning electrodes $\mathbf{3}_1$ to $\mathbf{3}_n$ of negative polarity. As a result, feeble discharge occurs in all the display cells, which causes wall charges of negative polarity on the scanning electrodes $\mathbf{3}_1$ to $\mathbf{3}_n$ and wall charges of positive polarity on the sustaining electrodes $\mathbf{4}_1$ to $\mathbf{4}_n$ to be completely erased.

Next, during the address period $T_A$, since the switch $\mathbf{25}_3$ of the sustaining driver 25 is turned ON (see FIG. 18) in response to the high-level sustaining driver control signal $S_{SUD3}$ (see (11) in FIG. 20) and, at the same time, the switches $\mathbf{23}_4$ and $\mathbf{23}_5$ are turned ON (see FIG. 17) in response to the scanning driver control signal $S_{SCD4}$ and $S_{SCD5}$, (see (6) and (7) in FIG. 20) being supplied from a latter half of the priming period $T_p$, the bias pulse $P_{EP}$ of positive polarity is applied to all the sustaining electrodes $\mathbf{4}_1$ to $\mathbf{4}_n$ (see (2) in FIG. 20) and the voltage of the pulses $P_{sc1}$ to $P_{SCn}$ to be applied to all the scanning electrodes $\mathbf{3}_1$ to $\mathbf{3}_n$ is maintained at the scanning base voltage $V_{bw}$, as shown in (1) in FIG. 20).

In such a state as described above, in order to perform writing to each of the display cells in every line, the switches $\mathbf{24}_{11}$ to $\mathbf{24}_{1n}$ of the scanning pulse driver 24 are sequentially turned OFF and the switches $\mathbf{24}_{21}$ to $\mathbf{24}_{2n}$ are sequentially turned ON (see FIG. 17) in response to the low-level scanning pulse driver control signals $S_{SPD11}$ to $S_{SPD1n}$ and the high-level scanning pulse driver control signals $S_{SPD21}$ to $S_{SPD2n}$ being fed with timing shown in (12) to (17) in FIG. 20. Moreover, though not shown, the switches $\mathbf{26}_{11}$ to $\mathbf{26}_{1n}$ of the data driver 26 are sequentially turned ON and the switches $\mathbf{26}_{21}$ to $\mathbf{26}_{2n}$ are sequentially turned OFF (see FIG. 19) in response to the high-level data driver control signals $S_{DD11}$ to $S_{DD1m}$ and the low-level data driver control signals $S_{DD21}$ to $S_{DD2m}$, all of which are used to display a black color on the PDP 1, to be fed with the same timing with which the corresponding scanning pulse driver control signals $S_{SPD11}$ to $S_{SPDin}$ and $S_{SPD21}$ to $S_{SPD2n}$ are supplied. Therefore, though a writing scanning pulse $P_{WSN}$ is applied to the scanning electrodes $\mathbf{3}_1$ to $\mathbf{3}_n$ in a line on which the writing is performed, for example, to the scanning electrode $\mathbf{3}_K$ as shown in (1) in FIG. 20, since a data pulse of positive polarity is not applied to any data electrodes $\mathbf{10}_1$ to $\mathbf{10}_m$, neither facing discharge nor surface discharge as writing discharge between the scanning electrode 3 ($\mathbf{3}_1$–$\mathbf{3}_n$) and the sustaining electrode 4 ($\mathbf{4}_1$–$\mathbf{4}_n$) to be triggered by the facing discharge occurs in any display cell. Therefore, an amount of the wall charges accumulated on the scanning electrodes $\mathbf{3}_1$ to $\mathbf{3}_n$ and sustaining electrodes $\mathbf{4}_1$ to $\mathbf{4}_n$ making up all the display cells is very small because there is left only the wall charge accumulated after the wall charge was erased in response to the first charge erasing pulse $P_{EEN1}$ of negative polarity.

Next, during the sustaining period $T_S$, since the switches $\mathbf{23}_2$ and $\mathbf{23}_6$ of the scanning driver 23 are turned ON/OFF (see FIG. 17) two or more times alternately in response to the scanning driver control signals $S_{SCD2}$ to $S_{SCD6}$ to be fed with timing shown in (4) and (8) in FIG. 20 and, at the same time, the switches $\mathbf{25}_1$ and $\mathbf{25}_2$ of the sustaining driver 25 are turned ON/OFF (see FIG. 18) two or more times alternately in response to the sustaining driver control signals $S_{SUD1}$ to $S_{SUD2}$ to be fed with timing shown in (9) and (10) in FIG. 20. Therefore, as shown in (1) in FIG. 20, a sustaining pulse $P_{SUN1}$ is applied two or more times to all the scanning electrodes $3_1$ to $3_n$ and a sustaining pulse $P_{SUN2}$ of negative polarity is applied two or more to all the sustaining electrodes $4_1$ to $4_n$. However, during the address period $T_A$, since no writing is performed on all the display cells, the amount of wall charges accumulated on the scanning electrodes $3_1$ to $3_n$ and sustaining electrodes $4_1$ to $4_n$ making up all the display cells are very small and, as a result, no sustaining discharge caused by superimposing of a voltage of the sustaining pulse $P_{SUN1}$ or $P_{SUN2}$ of negative polarity on a voltage of the wall charge occurs and the display cell does not emit light accordingly.

Next, during the electric charge erasing period $T_E$, since the switch $23_3$ of the scanning driver 23 is turned ON (see FIG. 17) in response to the high-level scanning driver control signal $S_{SCD3}$ (see (5) in FIG. 20), a second charge erasing pulse $P_{EEN2}$ of negative polarity shown in (1) in FIG. 20 is applied to all the scanning electrodes $3_1$ to $3_n$. Therefore, feeble discharge occurs in all the display cells and, as a result, the wall charges of negative polarity accumulated on the scanning electrodes $3_1$ to $3_n$ and the wall charges of positive polarity accumulated on the sustaining electrode $4_1$ to $4_n$ making up the display cell that had emitting light during the sustaining period $T_s$ are completely erased and a state of the charge in the display cells making up the PDP 1 is made uniform.

The conventional driving circuit of the PDP 1, immediately after power is turned ON, operates on a precondition that, when the power is turned ON, electric charges have not been accumulated on the scanning electrode 3 ($3_1$–$3_n$), sustaining electrode 4 ($4_1$–$4_n$) and data electrode 10 ($10_1$–$10_m$) making up each of the display cells. However, in reality, for example, as shown in FIG. 21A, some electric charges reside on the scanning electrode 3 ($3_1$–$3_n$), sustaining electrode 4 ($4_1$–$4_n$), and data electrode 10 ($10_1$–$10_m$) making up some of the display cells. In the example shown in FIG. 21A, electric charges being equivalent to −50 Volts of negative polarity reside on the scanning electrode 3 ($3_1$–$3_n$), electric charges being equivalent to 30 Volts of positive polarity reside on the sustaining electrode 4 ($4_1$–$4_n$) and electric charges being equivalent to 30 Volts of positive polarity reside on the data electrode 10 ($10_1$–$10_m$). In this case, a potential difference in the wall charges between the scanning electrode 3 ($3_1$–$3_n$) and sustaining electrode 4 ($4_1$–$4_n$) being adjacent to each other is −80 Volts. Such the residual wall charges are produced mainly due to differences in time taken when each of the priming voltage $V_p$, sustaining voltage $V_s$ and scanning base voltage $V_{bw}$ applied to the scanning driver 23, sustaining voltage $V_s$ and bias voltage $V_{sw}$ applied to the sustaining driver 25 and data voltage $V_d$ applied to the data driver 26, which had been fed from the driving power source 21, drops from a predetermined level to 0 Volts at a time when the power is turned OFF in the driving circuit of the PDP 1 and, therefore, it is almost impossible to completely erase the above residual wall charges at the time when the power is turned OFF.

Therefore, during the above address period $T_A$, in the state where the difference in voltage, caused by the residual wall charges, between the scanning electrode 3 ($3_1$–$3_n$) and sustaining electrode 4 ($4_1$–$4_n$) being adjacent to each other is −80 Volts, since the bias pulse $P_{BP}$ of about 195 Volts of positive polarity is applied to all the sustaining electrodes $4_1$ to $4_n$ and since the writing scanning pulse $P_{WSN}$ of 0 Volts of negative polarity is applied to the scanning electrode 3 ($3_1$–$3_n$) in a line on which the writing is performed, a voltage of 275 Volts in total is applied between the scanning electrode 3 ($3_1$–$3_n$) and sustaining electrode 4 ($4_1$–$4_n$). If a discharge starting voltage is 220 Volts, though the high-level data driver control signals $S_{DD11}$ to $S_{DD1M}$ and the low-level data driver control signals $S_{DD21}$ to $S_{DD2m}$ are fed to the data driver 26 in order to cause a black color to be displayed on the entire PDP 1, surface discharge occurs between the scanning electrode 3 ($3_1$–$3_n$) and sustaining electrode 4 ($4_1$–$4_n$) as shown in FIG. 21B and, as a result, wall charges of positive polarity are accumulated, which act to counter voltages being already applied, on the scanning electrode 3 ($3_1$–$3_n$) making up the display cell in which the surface discharge has occurred and wall charges of negative polarity are accumulated, which also act to counter voltages being already applied, on the sustaining electrode 4 ($4_1$–$4_n$) making up the display cell in which the surface discharge has occurred (see FIG. 21C). In the example shown in FIG. 21C, a voltage of 60 Volts of positive polarity is accumulated on the scanning electrode 3 ($3_1$–$3_n$) and a voltage of −60 Volts of negative polarity is accumulated on the sustaining electrode 4 ($4_1$–$4_n$).

Next, during the sustaining period $T_s$, in the display cell in which the surface discharge has occurred during the above address period $T_A$, since the wall charges of positive polarity are accumulated on the scanning electrode 3 ($3_1$–$3_n$) making up the display cell and the wall charges are accumulated on the sustaining electrode 4 ($4_1$–$4_n$) also making up the display cell, the sustaining pulse $P_{SUN1}$ of 180 Volts of positive polarity is applied to all the scanning electrodes $3_1$ to $3_n$ and, when the sustaining pulse $P_{SUN1}$ of 0 Volts of negative polarity is applied to all the sustaining electrodes $4_1$ to $4_n$, since the applied sustaining pulse $P_{SUN2}$ is superimposed on the wall charges of negative polarity being accumulated on the sustaining electrode 4 ($4_1$–$4_n$), a total of 300 Volts being a sum of the difference (120 Volts) produced by the wall charges between the scanning electrode 3 ($3_1$–$3_n$) and sustaining electrode 4 ($4_1$–$4_n$) and the difference (180 Volts) in the applied voltage between the scanning electrode 3 ($3_1$–$3_n$) and sustaining electrode 4 ($4_1$–$4_n$) is applied between the scanning electrode 3 (31–3n) and sustaining electrode 4 ($4_1$–$4_n$) Therefore, as shown in FIG. 21C, the surface discharge occurs between the scanning electrode 3 ($3_1$–$3_n$) and sustaining electrode 4 ($4_1$–$4_n$). As a result, the wall charges of negative polarity are accumulated, which act to counter the applied voltage, on the scanning electrode 3 ($3_1$–$3_n$) making up the display cell in which the surface discharge has occurred and the wall charges of positive polarity are accumulated, which act to counter the applied voltage, on the sustaining electrode 4 ($4_1$–$4_n$) making up the display cell in which the surface discharge has occurred. Thereafter, same operations as above are repeated, which cause the display cell to erroneously emit light and a useless display to be produced in the PDP 1. This phenomenon occurs due to following reasons.

That is, originally, the residual wall charges ought to be erased together at the same time when the wall charges accumulated on the scanning electrodes $3_1$ to $3_n$ and sustaining electrodes $4_1$ to $4_n$ based on the priming discharge occurred in a first half of the priming period $T_p$ are erased by the first charge erasing pulse $P_{EEN1}$ in the latter half of the priming period $T_p$. However, since the driving power source 21 causes both the sustaining voltage $V_S$ and bias voltage $V_{SW}$ to rise at almost the same time, the sustaining voltage $V_S$ does not fully reach a predetermined voltage in the latter half of the priming period $T_p$ occurring, in terms of time, before the address period $T_A$ and, as a result, the above residual wall charges cannot be completely erased. Nevertheless, there is a case where the bias voltage $V_{SW}$ has reached the predetermined voltage value and, in this case, the surface discharge occurs easily.

To solve this problem, a method is disclosed in, for example, Japanese Patent No. 2823126 in which image display in the PDP 1 is prohibited during at least one period of a vertical sync signal after power is turned ON. However, in this method, though the image display is merely and mechanically prohibited during at least one period of the vertical sync signal after the power has been turned ON, no consideration is given to a characteristic of the PDP 1 or its driving circuit, in particular to a rising characteristic, to be observed at the time when the power is turned ON, of the sustaining voltage $V_S$ to be fed from the driving power source 21, priming voltage $V_p$, scanning base voltage $V_{bw}$ and bias voltage $V_{sw}$. Therefore, even by using the disclosed method, it is impossible to completely prevent the useless display occurring at the time when the power is turned ON.

This requires strict specifications of characteristics of the driving power source 21 so as to meet conditions defined by the characteristic of operations of the PDP 1 or its driving circuit, however, in that case, the driving power source 21 has to be prepared individually for every PDP 1 or its driving circuit, which causes a loss of general versatility of the driving power source 21. Moreover, since there is a likelihood that the rising characteristics of the sustaining voltage $V_s$, priming voltage $V_p$, and scanning base voltage $V_{bw}$ at the time of the power-ON are changed not only by the single characteristic of the driving power source 21 but also by capacitance of capacitors making up smoothing circuits being connected to the driving power source 21 or parasitic capacitance produced by routing of wirings, unless considerations are given to these factors, it is impossible to achieve a complete prevention of the useless display appearing when the power is turned ON.

SUMMARY OF THE INVENTION

In view of the above, it is an object of the present invention to provide a method and a circuit for driving a PDP, and a plasma display device having the driving circuit which are capable of preventing a useless display occurring at a time of power-ON, irrespective of characteristics of a driving power source.

According to a first aspect of the present invention, there is provided a method for driving a plasma display panel, the plasma display panel including a plurality of pairs of surface discharge electrodes each pair of the surface discharge electrodes being made up of a scanning electrode and a sustaining electrode and each scanning electrode and sustaining electrode being formed successively in a column direction and being parallel to a row direction and a plurality of data electrodes each being formed successively in the row direction and being parallel to a column direction, forming pixels at intersections of the plurality of the data electrodes and the plurality of the pairs of surface discharge electrodes, and discharge space existing in a gap between a plane on which the plurality of the pairs of surface discharge electrodes is formed and a plane on which the plurality of the data electrodes is formed, including:

a step of applying, immediately after power is turned ON, a pulse having an erasing pulse which causes a maximum potential difference between the sustaining electrode and the scanning electrode being adjacent to each other to reach at least a sustaining voltage, to the scanning electrode.

In the foregoing, a preferable mode is one wherein, after power is turned ON, the pulse having the erasing pulse is applied repeatedly to the scanning electrode until the sustaining voltage reaches a predetermined voltage value.

Also, a preferable mode is one, wherein, after power is turned ON, the pulse having the erasing pulse is applied to the scanning electrode repeatedly for predetermined time.

Also, a preferable mode is one wherein, the pulse having the erasing pulse and being applied to the scanning electrode has a priming period, address period, and sustaining period; and wherein the erasing pulse is produced during the priming period.

Also, a preferable mode is one wherein, the pulse having the erasing pulse and being applied to the scanning electrode has a first priming period, second priming period, address period, and sustaining period, and wherein the erasing pulse is fed during the first priming period and is made up of a priming pulse which causes a maximum potential difference between the scanning electrode and the sustaining electrode being adjacent to each other to reach at least priming voltage in order to cause priming discharge to occur during the second priming period and of a second erasing pulse used to reduce wall charges accumulated both on the scanning electrode and sustaining electrode being adjacent to each other caused by the priming discharge.

Also, a preferable mode is one wherein, after the pulse having the erasing pulse has been applied, a pulse having a priming period and address period and having a writing scanning pulse which causes a potential difference between the scanning electrode and the sustaining electrode being adjacent to each other during the address period to become a sustaining voltage, is applied during the address period to the scanning electrode.

According to a second aspect of the present invention, there is provided a circuit for driving a plasma display panel, the plasma display panel having a plurality of pairs of surface discharge electrodes each pair of the surface discharge electrodes being made up of a scanning electrode and a sustaining electrode and each scanning electrode and sustaining electrode being formed successively in a column direction and being parallel to a row direction and a plurality of data electrodes each being formed successively in the row direction and being parallel to the column direction, forming pixels at intersections of the plurality of the data electrodes and the plurality of the pairs of surface discharge electrodes, and discharge space existing in a gap between a plane on which the plurality of the pairs of surface discharge electrodes is formed and a plane on which the plurality of the data electrodes is formed, including:

a controller to produce, immediately after power is turned ON, a control signal used to apply a pulse having an erasing pulse which causes a maximum potential difference between the sustaining electrode and the scanning electrode being adjacent to each other to reach at least a sustaining voltage, to the scanning electrode.

In the foregoing, a preferable mode is one that wherein includes:

a voltage detection circuit to detect, after power is turned ON, the sustaining voltage which has reached a predetermined voltage; and wherein the controller produces the control signal repeatedly until the voltage detection circuit detects the sustaining voltage that has reached a predetermined voltage value.

Also, a preferable mode is one that wherein includes a timer to measure predetermined time after power is turned ON and wherein the controller produces the control signal repeatedly until the timer has measured the predetermined time.

Also, a preferable mode is one wherein the pulse having the erasing pulse and being applied to the scanning electrode has a priming period, address period and sustaining period; and wherein the erasing pulse is produced in the priming period.

Also, a preferable mode is one wherein, the pulse having the erasing pulse and being applied to the scanning electrode has a first priming period, second priming period, address period, and sustaining period, and wherein the erasing pulse is fed during the first priming period and is made up of a priming pulse which causes a maximum potential difference between the scanning electrode and the sustaining electrode being adjacent to each other to reach at least a priming voltage in order to cause priming discharge to occur during the second priming period and of a second erasing pulse used to reduce wall charges on the scanning electrode and sustaining electrode being adjacent to each other caused by the priming discharge.

Also, a preferable mode is one wherein the controller, after applying the pulse having the erasing pulse, produces a control signal having a priming period and address period and writing scanning pulse to cause a potential difference between the scanning electrode and the sustaining electrode being adjacent to each other to become a sustaining voltage during the address period.

According to a third aspect of the present invention, there is provided a plasma display device being provided with a driving circuit of a plasma display stated in any one of the second aspect.

According to a fourth aspect of the present invention, there is provided a plasma display panel device being equipped with a controller which produces a control signal used to apply, immediately after power is turned ON, a pulse having an erasing pulse causing a maximum potential difference between a scanning electrode and a sustaining electrode being adjacent to each other to reach a sustaining voltage to the scanning electrode.

With above configurations, a pulse having an erasing pulse which causes a maximum potential difference between a sustaining electrode and a scanning electrode being adjacent to each other to reach at least a sustaining voltage, is applied, immediately after power is applied, to the scanning electrode and therefore a useless display can be prevented at a time of power-ON, irrespective of characteristics of the driving power source.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

First Embodiment

Figure 1:
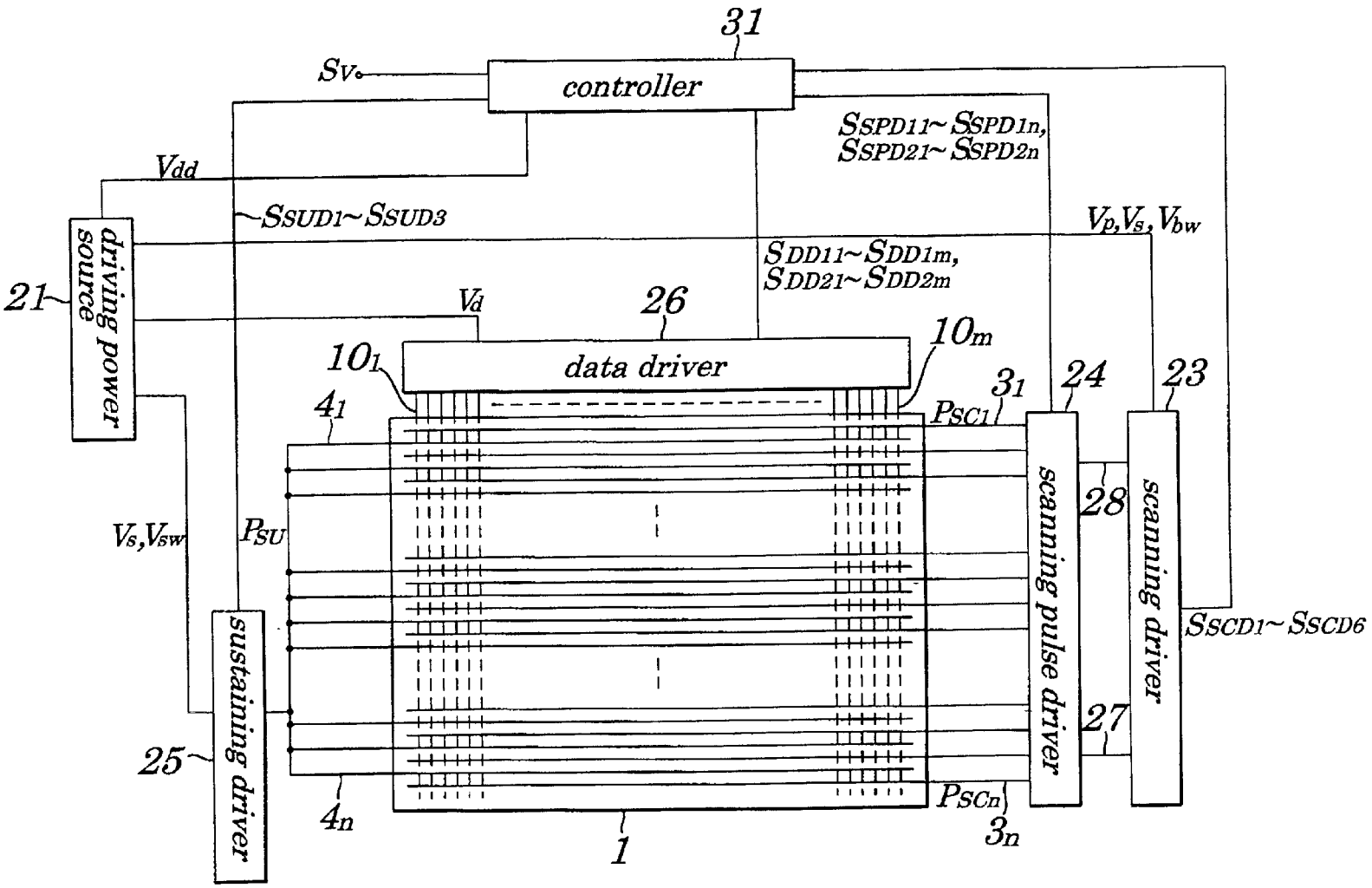
FIG. 1 is a schematic block diagram showing configurations of a driving circuit of a PDP according to a first embodiment of the present invention.

FIG. 1 is a schematic block diagram showing configurations of a driving circuit of a PDP 1 according to a first embodiment of the present invention. In FIG. 1, same reference numbers are assigned to corresponding parts having same functions as those in FIG. 16 and their descriptions are omitted accordingly. In the driving circuit of the PDP 1 shown in FIG. 1, instead of a controller 22 shown in FIG. 16, a controller 31 is newly provided. The controller 31 has same configurations as those of the controller 22. Types of control signals produced by the controller 31 based on a video signal $S_v$ fed from an outside and output to other units are the same as those of the controller 22 shown in FIG. 16, however, waveforms of control signals employed in the controller 31 are different from those employed in the controller 22. Their waveforms will be described in detail later.

Figure 2:
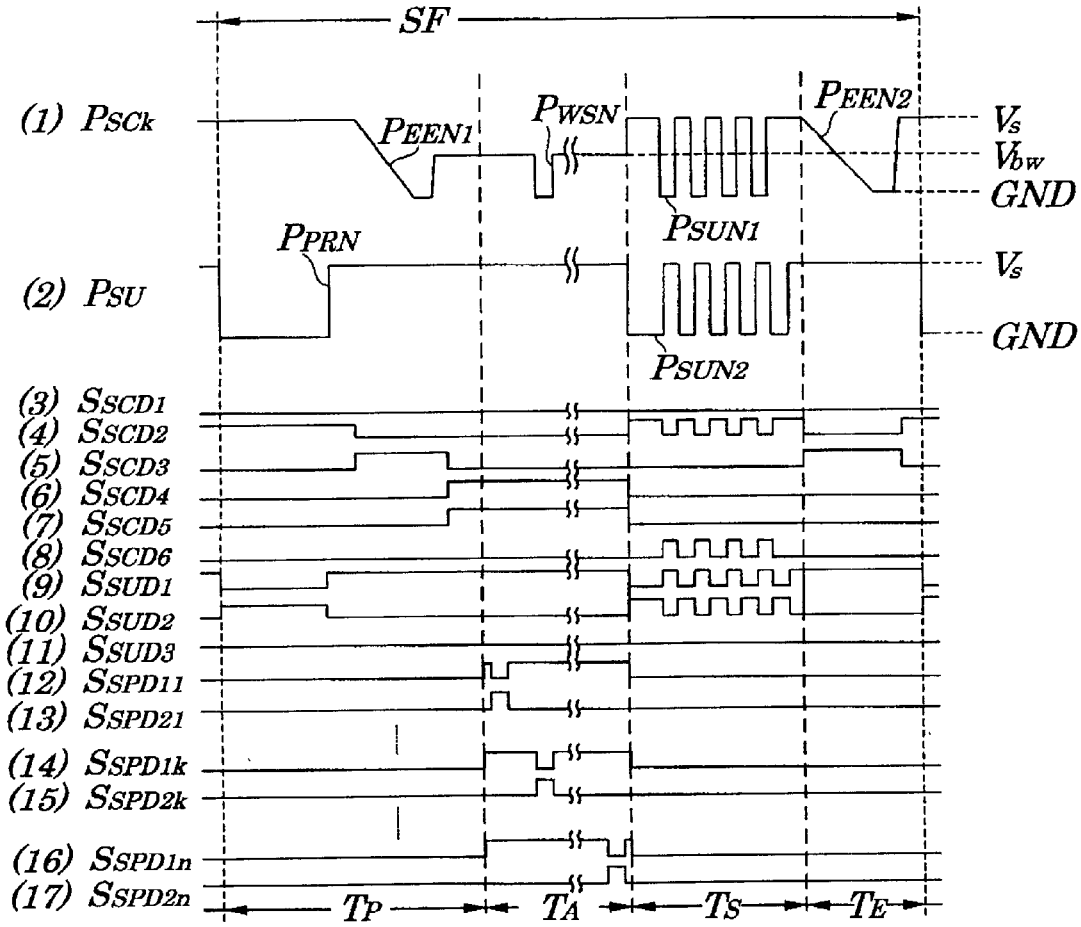
FIG. 2 is a timing chart showing one example of operations of the driving circuit performed immediately after power-ON according to the first embodiment of the present invention.
Figure 3:
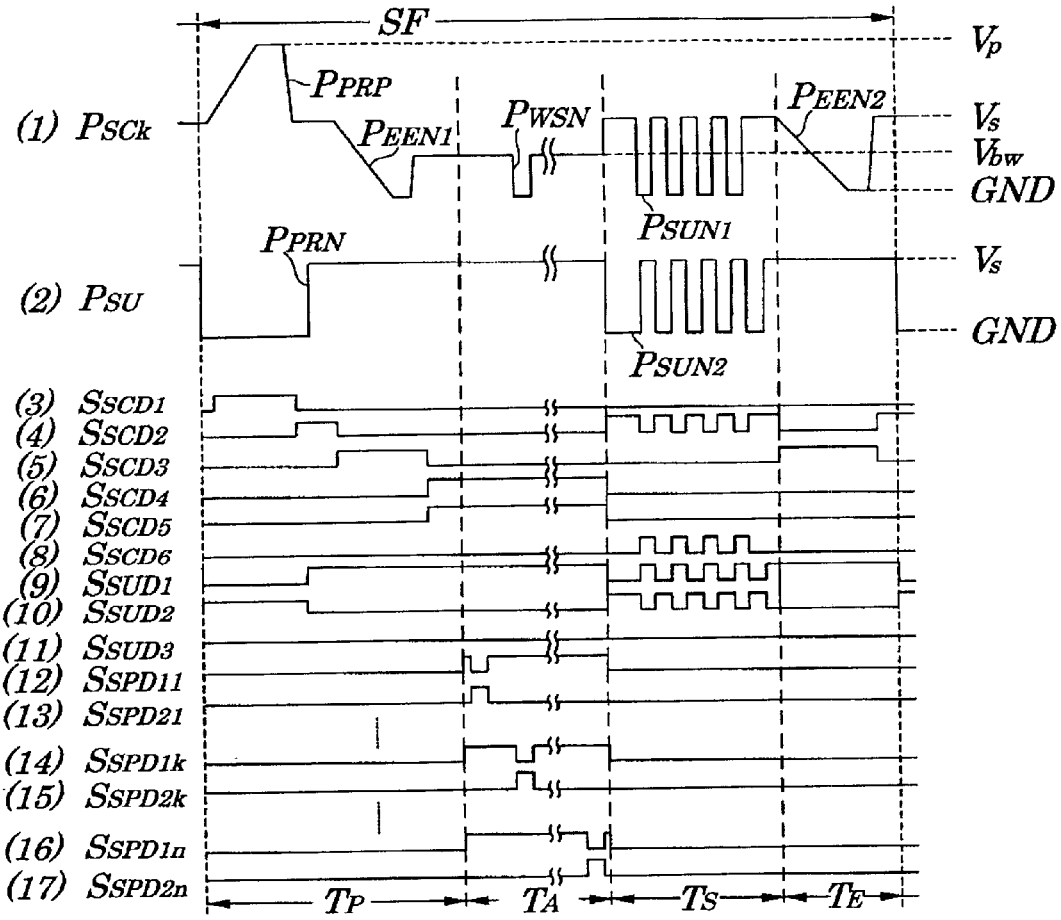
FIG. 3 is a timing chart showing another example of operations of the driving circuit performed immediately after the power-ON according to the first embodiment of the present invention.
Figure 4A:
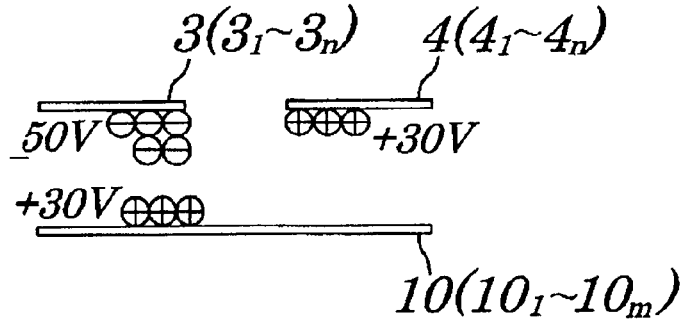
FIGS. 4A, 4B, and 4C are schematic diagrams showing distribution of electric charges to explain one example of operations of the driving circuit performed immediately after power-ON according to the first embodiment of the present invention.

Next, operations of the driving circuit of the PDP 1 having above configurations performed immediately after a power-ON will be explained by referring to FIGS. 2 and 3. Amplitudes of a pulse $P_{SCk}$ ("k" is a natural number and $1 \leqq k \leqq n$) to be fed to a scanning side shown in (1) in FIG. 2 and (1) in FIG. 3 and of a sustaining pulse P, shown in (2) in FIG. 2 and (2) in FIG. 3 are determined in a relative manner. Moreover, since it is immediately after the power-ON that the pulses having waveforms shown in (1) and (2) in FIG. 2 are applied to a scanning electrode 3 ($3_1$–$3_n$) and a sustaining electrode 4 ($4_1$–$4_n$), voltage values of a sustaining voltage $V_s$, a priming voltage $V_p$, and a bias voltage $V_{sw}$ are transitory ones which have not yet reached a predetermined level. Moreover, in a description of the first embodiment, let it be assumed, as shown in FIG. 4A, that, when power is turned OFF, electric charges being equivalent to a voltage of −50 of negative polarity reside on the scanning electrode 3 ($3_1$–$3_n$) making up a display cell, electric charges being equivalent to a voltage of 30 Volts of positive polarity reside on the sustaining electrode 4 ($4_1$–$4_n$) also making up the display cell, and electric charges being equivalent to a voltage of 30 Volts of positive polarity reside on a data electrode 10 ($10_1$–$10_m$) also making up the display cell and that a potential difference caused by wall charges between the scanning electrode 3 ($3_1$–$3_n$) and sustaining electrode 4 ($4_1$–$4_n$) being adjacent to each other is −80 Volts.

When power is turned ON, a driving power source 21 starts feeding a logic voltage $V_{dd}$ to the controller 31. The controller 31, in response to input of the logic voltage $V_{dd}$, initializes its internal circuits and then produces, based on a video signal $S_v$ fed from the outside, scanning driver control signals $S_{SCD1}$ to $S_{SCD6}$ shown in (3) to (8) in FIG. 2, sustaining driver control signals $S_{SUD1}$ to $S_{SUD3}$ shown in (9) to (11) in FIG. 2, scanning pulse driver control signals $S_{SPD11}$ to $S_{SPD1n}$, and $S_{SPD21}$ to $S_{PD2n}$ (not shown partly), and high-level data driver control signals $S_{DD11}$ to $S_{DD1m}$ and low-level data driver control signals $S_{DD21}$ to $S_{DD2m}$ (shown in FIG. 1) both being supplied to display a black color on the entire PDP 1 and starts feeding each of corresponding signals to a scanning driver 23, a sustaining driver 25, a scanning pulse driver 24, and a data driver 26.

Figure 18:
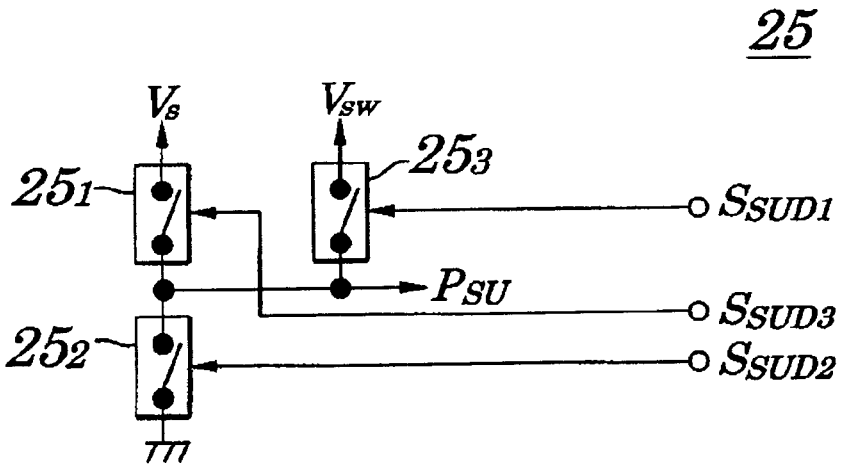
FIG. 18 (PRIOR ART)
FIG. 18 is a circuit diagram showing an example of configurations of a sustaining driver in the driving circuit of FIG. 16.

Next, the driving power source 21, when a few hundred milliseconds have elapsed after having had started applying the logic voltage $V_{dd}$ to the controller 31, starts feeding the sustaining voltage $V_s$, the priming voltage $V_p$, and a scanning base voltage $V_{bw}$ to the scanning driver 23, the sustaining voltage $V_s$, the bias voltage $V_{sw}$, and data voltage $V_d$ to the data driver 26. As a result, during a priming period $T_p$, since a switch $25_2$ of the sustaining driver 25 is turned ON (see FIG. 18) in response to the high-level sustaining driver control signal $S_{SUD2}$ (see (10) in FIG. 2) and a switch $23_2$ of the scanning driver 23 has been turned ON in response to the high-level scanning driver control signal $S_{scD2}$ (see (4) in FIG. 2) that had been supplied immediately before a start of a subfield period SF, all scanning electrodes $3_1$ to $3_n$ are held at the sustaining voltage $V_s$, as shown in (1) in FIG. 2 and a priming pulse $P_{PRN}$ of negative polarity shown in (2) in FIG. 2 is applied to all sustaining electrodes $4_1$ to $4_n$. That is, though the sustaining voltage $V_s$ is applied between the scanning electrodes $3_1$ to $3_n$ and sustaining electrodes $4_1$ to $4_n$ in all display cells, no voltage required for priming discharge is applied and, as a result, no priming discharge occurs in a discharging gas space 14 (not shown) in a vicinity of a gap between the scanning electrodes $3_1$ to $3_n$ and the sustaining electrodes $4_1$ to $4_n$ in all the display cells. Moreover, in a display cell, even when residual wall charges exist in the scanning electrode 3 ($3_1$–$3_n$), the sustaining electrode 4 ($4_1$–$4_n$), and the data electrode 10 ($10_1$–$10_m$) as shown in FIG. 4A and even if a potential difference caused by the wall charges between the scanning electrode 3 ($3_1$–$3_n$) and the sustaining electrode 4 ($4_1$–$4_n$)being adjacent to each other is −80 Volts, since only the sustaining voltage V, of about 180 Volts is applied between the scanning electrode 3 ($3_1$–$3_n$) and the sustaining electrode 4 ($4_1$–$4_n$) and since this voltage value does not exceed a discharge starting voltage (in the example, 220 Volts), no discharge occurs.

Figure 17:
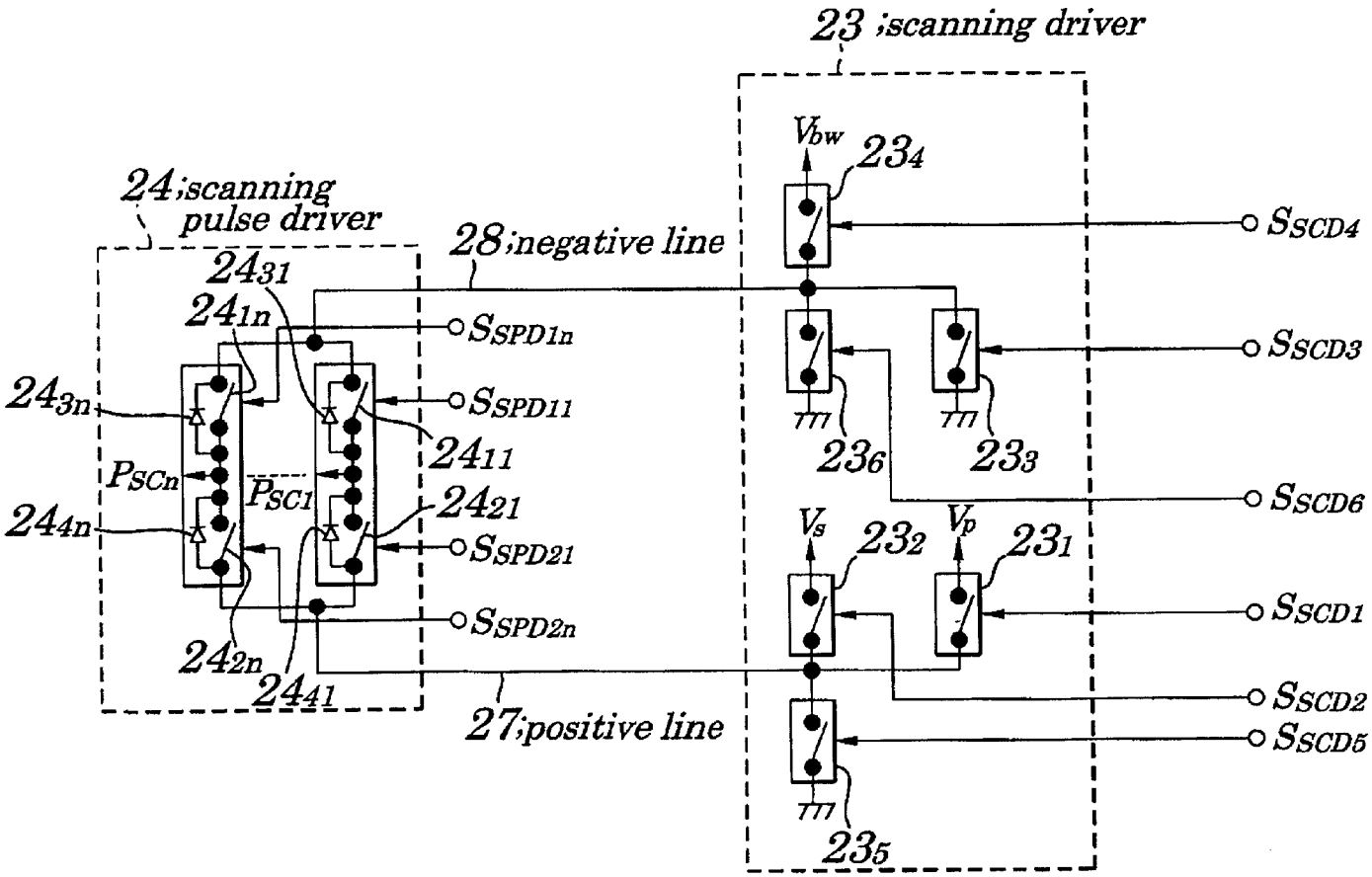
FIG.17 (PRIOR ART)
FIG. 17 is a circuit diagram showing an example of configurations of a scanning driver and a scanning pulse driver in the driving circuit of FIG. 16.

Next, when the high-level sustaining driver control signal $S_{SUD2}$ (see (10) in FIG. 2) goes low, the switch $25_2$ of the sustaining driver 25 is turned ON (see FIG. 18) and, at the same time, a switch $25_1$ of the sustaining driver 25 is turned ON (see FIG. 18) when the high-level sustaining driver control signal $S_{SUD1}$ (see (9) in FIG. 2) goes high and then a switch $23_3$ is turned ON (see FIG. 17) in response to the high-level sustaining driver control signal $S_{SUD1}$ (see (5) in FIG. 2). Then, after all the sustaining electrodes $4_1$ to $4_n$ have been held at the sustaining voltage $V_s$ of about 180 Volts, a first charge erasing pulse $P_{EEN1}$ of negative polarity is applied to all the scanning electrodes $3_1$ to $3_n$ in (1) in FIG. 2.

Figure 4B:
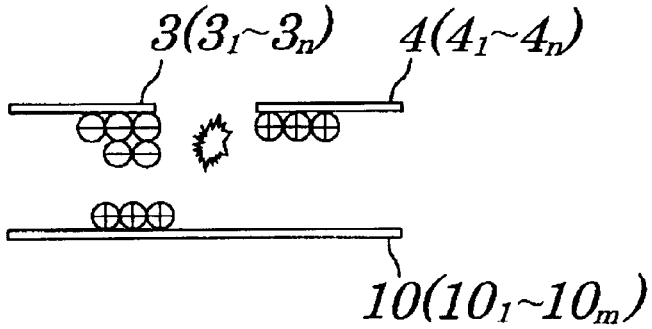
Figure 4C:
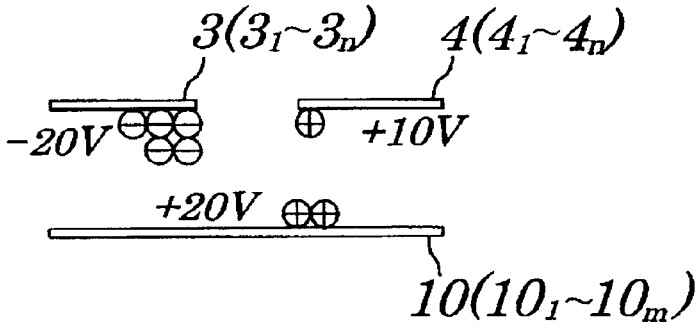

Therefore, in the display cell on which residual wall discharges are accumulated, in a state in which there is the potential difference of −80 Volts caused by the residual wall charges between the scanning electrode 3 ($3_1$–$3_n$) and the sustaining electrode 4 ($4_1$–$4_n$) being adjacent to each other, since the sustaining electrode 4 ($4_1$–$4_n$) is held at the sustaining voltage $V_S$ of about 180 Volts and, moreover, the first charge erasing pulse $P_{EEN1}$ of 0 Volts of negative polarity is applied to the scanning electrode 3 ($3_1$–$3_n$) and, therefore, a voltage of about 260 Volts in total is applied between the scanning electrode 3 ($3_1$–$3_n$) and the sustaining electrode 4 ($4_1$–$4_n$). Thus, the voltage between the scanning electrode 3 ($3_1$–$3_n$) and the sustaining electrode 4 ($4_1$–$4_n$) exceeds the discharge starting voltage of 220 Volts and, as shown in FIG. 4B, feeble discharge occurs and, as a result, as shown in FIG. 4C, wall charges of negative polarity on the scanning electrode 3 ($3_1$–$3_n$) and wall charges of polarity on the sustaining electrode 4 ($4_1$–$4_n$) are somewhat erased. In the example shown in FIG. 4C, electric charges being equivalent to a voltage of −20 Volts of negative polarity reside on the scanning electrode 3 ($3_1$–$3_n$), electric charges being equivalent to a voltage of 10 Volts of positive polarity reside on the sustaining electrode 4($4_1$–$4_n$) and electric charges being equivalent to a voltage of 20 Volts of positive polarity reside on the data electrode 10 ($10_1$–$10_m$) and therefore a potential difference caused by the wall charges between the scanning electrode 3 ($3_1$–$3_n$) and the sustaining electrode 4 ($4_1$–$4_n$) being adjacent to each other is −30 Volts. Moreover, in other display cells in which the residual wall charges are not accumulated, since only the sustaining voltage $V_s$ of about 180 Volts is applied between the scanning electrode 3 ($3_1$–$3_n$) and the sustaining electrode 4 ($4_1$–$4_n$) and, since this voltage does not exceed the discharge starting voltage 220 Volts, no discharge occurs.

Next, since a switch $25_1$ of the sustaining driver 25 is turned ON (see FIG. 18) in response to the high-level sustaining driver control signal $S_{SUD1}$ (see (9) in FIG. 2) that has been fed from a first half of the priming period $T_p$ and switches $23_4$ and $23_5$ of the scanning driver 23 have been turned ON (see FIG. 17) in response to the high-level scanning driver control signal $S_{SCD4}$ and $S_{SCD5}$ (see (6) and (7) in FIG. 2) that have been fed from a latter half of the priming period $T_p$, all the sustaining electrodes $4_1$ to $4_n$ are held at the sustaining voltage $V_s$ of about 180 Volts, as shown in (2) in FIG. 2, and voltages of pulses $P_{SC1}$ to $P_{SCn}$ to be applied to all the scanning electrodes $3_1$ to $3_n$ are held at the scanning base voltage $V_{bw}$ of about 100 Volts.

Figure 19:
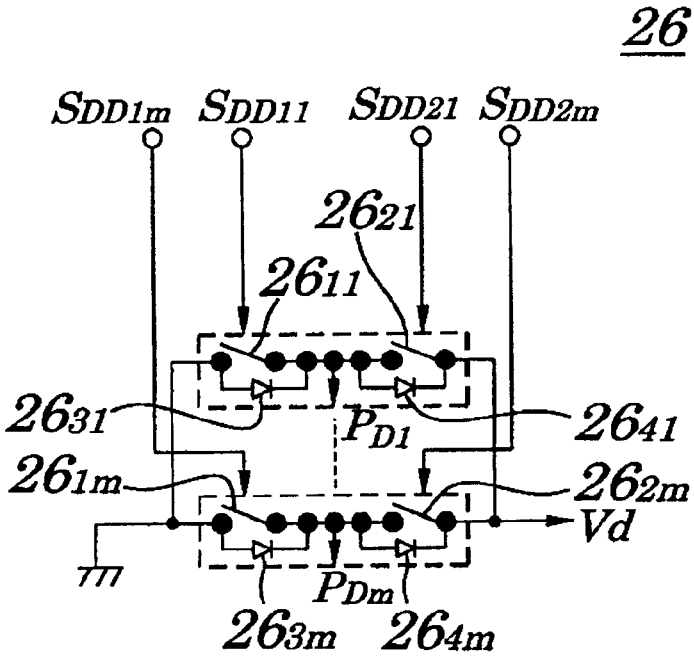
FIG. 19 (PRIOR ART)
FIG. 19 is a circuit diagram showing an example of configurations of a data driver in the driving circuit of FIG. 16.

In such the state, in order to perform writing to each of the display cells in every line, switches $24_{11}$ and $24_{1n}$ of the scanning pulse driver 24 are sequentially turned OFF and switches $24_{21}$ to $24_{2n}$ are sequentially turned ON (see FIG. 17) in response to the low-level scanning pulse driver control signals $S_{SPD11}$ to $S_{SPD1n}$ and the high-level scanning pulse driver control signals $S_{SPD21}$ to $S_{SPD2n}$ being fed with timing shown in (12) to (17) in FIG. 2. Moreover, though not shown, switches $26_{11}$ to $26_{1n}$ of the data driver 26 are sequentially turned ON and switches $26_{21}$ to $26_{2n}$ of the data driver 26 are sequentially turned OFF (see FIG. 19) in response to the high-level data driver control signals $S_{DD11}$ to $S_{DD1m}$ and the low-level data driver control signals $S_{DD21}$ to $S_{DD2m}$, all of which are fed with the same timing with which corresponding scanning pulse driver control signals $S_{SPD11}$ to $S_{SPD1n}$ and $S_{SPD21}$ to $S_{SPD2n}$ are fed and which are used to display a black color on the entire PDP 1. Therefore, though a writing scanning pulse $P_{WSN}$ of negative polarity is applied to one of the scanning electrode $3_1$ to $3_n$ in a line to which the writing is performed, for example, to a scanning electrode $3_b$, as shown in (1) in FIG. 2, no data pulse of positive polarity is applied to any one of data electrodes $10_1$ to $10_m$.

If, therefore, the scanning electrode 3 ($3_1$–$3_n$) making up the display cell in which the residual wall charges are accumulated corresponds to the scanning electrode 3 ($3_1$–$3_n$) in the line to which the writing is performed, in the above display cell and in the state in which there is the potential difference of −30 Volts caused by the residual wall charges between the scanning electrode 3 ($3_1$–$3_n$) and the sustaining electrode 4 ($4_1$–$4_n$) being adjacent to each other, since the sustaining electrode 4 ($4_1$–$4_n$) is held at the sustaining voltage $V_S$ of −180 Volts and the writing scanning pulse $P_{WSN}$ of 0 Volts of negative polarity is applied to the scanning electrode 3 ($3_1$–$3_n$), a voltage of about 210 Volts in total is applied between the scanning electrode 3 ($3_1$–$3_n$) and the sustaining electrode 4 ($4_1$–$4_n$). As a result, since the voltage between the scanning electrode 3 ($3_1$–$3_n$) and the sustaining electrode 4 ($4_1$–$4_n$) does not exceed the discharge starting voltage 220 Volts, neither facing discharge nor surface discharge as writing discharge between the scanning electrode 3 ($3_1$–$3_n$) and the sustaining electrode 4 ($4_1$–$4_n$) to be triggered by the facing discharge occurs in any display cell. That is, no discharge occurs. Moreover, in other display cells in which the residual wall charges are not accumulated, since only the sustaining voltage $V_s$ of about 180 Volts is applied between the scanning electrode 3 ($3_1$–$3_n$) and the sustaining electrode 4 ($4_1$–$4_n$) and since this voltage does not exceed the discharge starting voltage 220 Volts, neither facing discharge nor surface discharge as writing discharge between the scanning electrode 3 ($3_1$–$3_n$) and the sustaining electrode 4 ($4_1$–$4_n$) to be triggered by the facing discharge occurs in any display cell.

Next, during a sustaining period $T_s$, since switches $23_2$ and switches $23_6$ of the scanning driver 23 are alternately turned ON/OFF two or more times (see FIG. 17) in response to the scanning driver control signals $S_{SCD2}$ and $S_{SCD6}$ being supplied with timing shown in (4) and (8) in FIG. 2 and switches $25_1$ and $25_2$ of the sustaining driver 25 are alternately turned ON/OFF two or more times (see FIG. 18) in response to the sustaining driver control signals $S_{SUD1}$ to $S_{SUD2}$ being supplied with timing shown in (9) and (10) in FIG. 2, though a sustaining pulse $P_{SUN1}$ of negative polarity is applied to all the scanning electrodes $3_1$ to $3_n$ two or more times as shown in (1) in FIG. 2, no writing is performed on all display cells during an address period $T_A$.

Therefore, in the display cell in which the residual wall charges are accumulated, in the state where there is the potential difference of −30 Volts caused by the residual wall charges between the scanning electrode 3 ($3_1$–$3_n$) and the sustaining electrode 4 ($4_1$–$4_n$) even when the sustaining pulse $P_{SUN1}$ of negative polarity is applied to the scanning electrode 3 ($3_1$–$3_n$) two or more times and a sustaining pulse $P_{SUN2}$ of negative polarity is applied to the sustaining electrode 4 ($4_1$–$4_n$) two or more times, only the sustaining pulse $P_{SUN2}$ having a voltage of about 210 Volts in total, whose polarity is alternately reversed, is applied between the scanning electrode 3 ($3_1$–$3_n$) and the sustaining electrode 4 ($4_1$–$4_n$) two or more times. As a result, since the voltage between the scanning voltage 3 and sustaining electrode 4 ($4_1$–$4_n$) does not exceed the discharge starting voltage 220 Volts, no sustaining discharge caused by superimposing of a voltage of the sustaining pulse $P_{SUN1}$ or $P_{SUN2}$ of negative polarity on a voltage of the wall charge occurs and the display cell does not emit light accordingly. Moreover, in the other display cells in which the residual wall charges are not accumulated, only the sustaining pulse having a voltage of about 180 Volts in total, whose polarity is alternately reversed, is applied between the scanning electrode 3 ($3_1$–$3_n$) and the sustaining electrode 4 ($4_1$–$4_n$) two or more times. As a result, since the voltage between the scanning voltage 3 and the sustaining electrode 4 ($4_1$–$4_n$) does not exceed the discharge starting voltage 220 Volts, no sustaining discharge caused by superimposing of a voltage of the sustaining pulse $P_{SUN1}$ or $P_{SUN2}$ of negative polarity on a voltage of the wall charges occurs and the display cell does not emit light accordingly.

Next, during a charge erasing period $T_E$, since a switch $23_3$ of the scanning driver 23 is turned ON in response to the high-level scanning driver control signal $S_{SCD3}$ (see (5) in FIG. 2), a second charge erasing pulse $P_{EEN2}$ of negative polarity is applied to all the scanning electrodes $3_1$ to $3_n$ shown in (1) in FIG. 2. Therefore, in all the display cells, feeble discharging occurs, which causes wall charges of negative polarity on the scanning electrode 3 ($3_1$–$3_n$) making up the display cell in which the residual wall charges are accumulated and wall charges of positive polarity on the sustaining electrode 4 ($4_1$–$4_n$) to be erased.

The driving circuit, after having performed the above operations to be done within one subfield period SF for several tens of periods, performs operations to be done within the subfield period SF corresponding to the timing chart shown in FIG. 3 for one period. Only operations during the priming period $T_p$ in the timing chart shown in FIG. 2 are different from those in FIG. 3 and only description of the operations during the priming period $T_p$ will be provided accordingly. At this point, the driving power source 21 is feeding the priming voltage $V_p$ and the scanning base voltage $V_{bw}$ each having a predetermined level to the scanning driver 23, the sustaining voltage $V_s$ and the bias voltage $V_{sw}$ each having a predetermined level to the sustaining driver 25, and the data voltage $V_d$ having a predetermined level to the data driver 26.

The controller 31, based on the video signal $S_v$ fed from the outside, produces scanning driver control signals $S_{SCD1}$ to $S_{SCD6}$ shown in (3) to (8) in FIG. 3, sustaining driver control signals $S_{SUD1}$ to $S_{SUD3}$ shown in (9) to (11) in FIG. 3, scanning pulse driver control signals $S_{SPD11}$ to $S_{SPD2n}$ shown in (12) to (17) in FIG. 3 and scanning pulse driver control signals $S_{SPD2n}$ to $S_{SPD2n}$ (partially not shown), high-level data driver control signal $S_{DD11}$ to $S_{DD1m}$ and low-level data driver control signals $S_{DD21}$ to $S_{DD2m}$ (not shown) which are all used to display a black color on the entire PDP 1 and feeds each of corresponding control signals to each of the scanning driver 23, the sustaining driver 25, the scanning pulse driver 24, and the data driver 26.

During the priming period $T_p$, the switch $\mathbf{23}_1$ of the scanning driver 23 is turned ON (see FIG. 17) in response to the high-level scanning driver control $S_{SCD1}$ (see (3) in FIG. 3) and the switch $\mathbf{25}_2$ of the sustaining driver 25 is turned ON (see FIG. 18) in response to the high-level sustaining driver control signal $S_{SUD2}$ (see (10) in FIG. 3). Therefore, a priming pulse $P_{PRP}$ of positive polarity shown in (1) in FIG. 3 is applied to all scanning electrodes $\mathbf{3}_1$ to $\mathbf{3}_n$ and the priming pulse $P_{PRN}$ of negative polarity is applied to all sustaining electrodes $\mathbf{3}_1$ to $\mathbf{3}_n$. Therefore, the priming charge occurs in the discharge gas space 14 in the vicinity of the gap between scanning electrodes $\mathbf{3}_1$ to $\mathbf{3}_n$ of all display cells, which produces active particles inducing easy occurrence of the display cell and, at the same time, wall charges of negative polarity are accumulated on the scanning electrode $\mathbf{3}_1$ to $\mathbf{3}_n$ while wall charges of positive polarity are accumulated on the sustaining electrode 4 ($\mathbf{4}_1$–$\mathbf{4}_n$).

Next, the switch $\mathbf{25}_2$ of the sustaining driver 25 is turned OFF when the high-level sustaining driver control signal $S_{SUD2}$ (see (10) in FIG. 3) goes low and the switch $\mathbf{25}_1$ of the sustaining driver 25 is turned ON (see FIG. 18) when the high-level sustaining driver control signal $S_{SUD1}$ (see (9) in FIG. 3) goes high. Then, since the switch $\mathbf{23}_3$ of the scanning driver 23 is turned ON in response to the high-level scanning driver control signal $S_{SCD3}$ (see (5) in FIG. 3), after all the sustaining electrodes $\mathbf{4}_1$ to $\mathbf{4}_n$ have been held at the sustaining voltage of 180 Volts, the first electrode erasing pulse $P_{EEN1}$ of negative polarity shown in (1) in FIG. 3 is applied to all the scanning electrodes $\mathbf{3}_1$ and $\mathbf{3}_n$. Therefore, feeble discharge occurs in all display cells, which causes wall charges of negative polarity on the scanning electrodes $\mathbf{3}_1$ to $\mathbf{3}_n$ and wall charges of positive polarity on the sustaining electrodes $\mathbf{4}_1$ to $\mathbf{4}_n$ to be erased completely.

Thereafter, same operations described by referring to FIG. 2 in the first embodiment are performed during the address period $T_A$, the sustaining period $T_S$ and the charge erasing period $T_E$.

The wall electrode of negative polarity on the scanning electrode 3 ($\mathbf{3}_1$–$\mathbf{3}_n$) making up the display cell in which the residual wall charges are accumulated and the wall electrode of positive polarity on the sustaining electrode 4 ($\mathbf{4}_1$–$\mathbf{4}_n$) also making up the display cell are completely erased by operations described above and the state of charging in all display cells making up the PDP 1 are made uniform.

Figure 20:
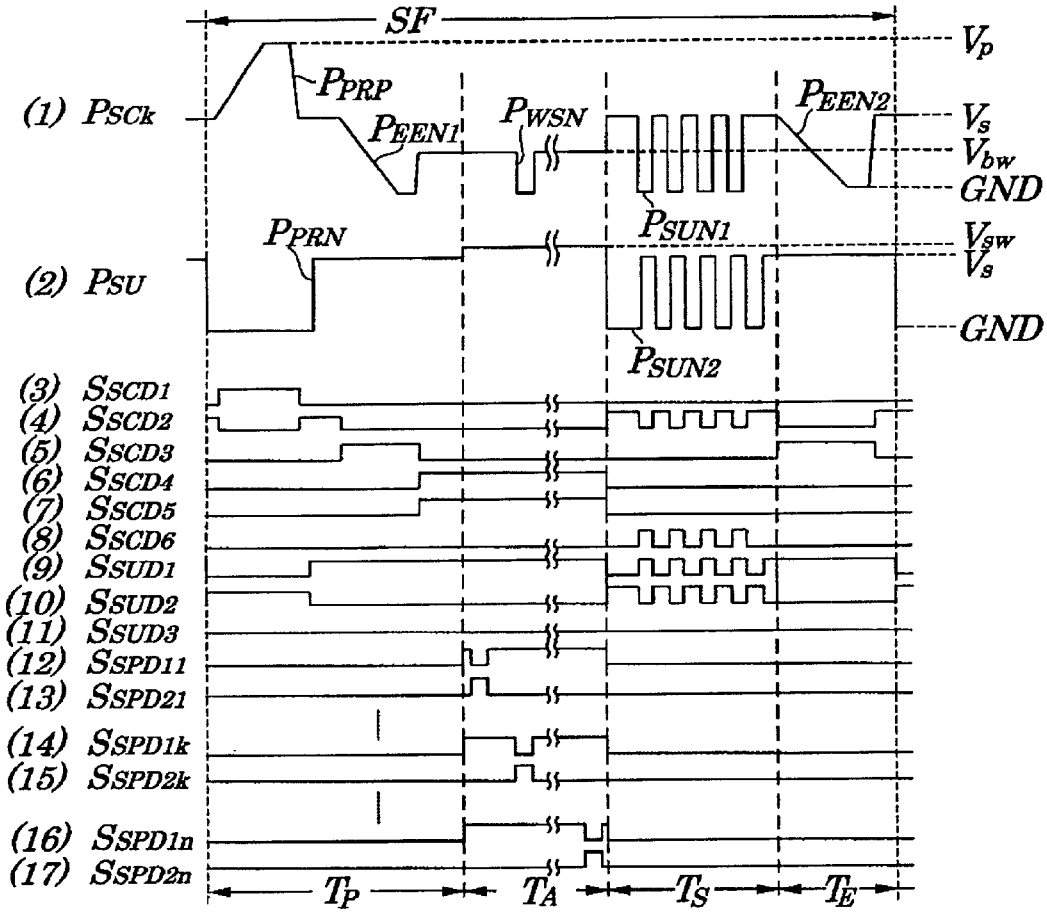
FIG.20 (PRIOR ART)
FIG. 20 is a timing chart showing one example of operations being performed immediately after power-ON in the driving circuit of FIG. 16.
Figure 21A:
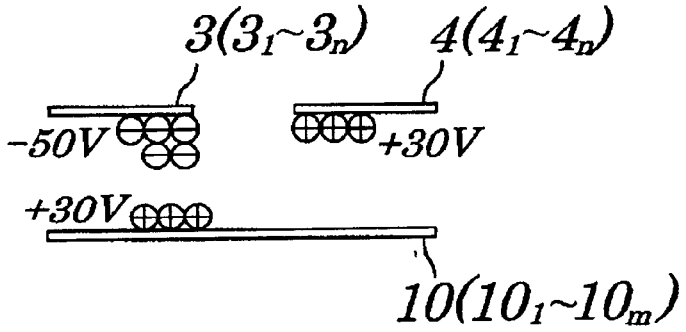
FIG.21A (PRIOR ART)
FIGS. 21A, 21B, and 21C are diagrams showing distribution of electric charges used to explain shortcomings in operations of the conventional driving circuit of FIG. 16.
Figure 21B:
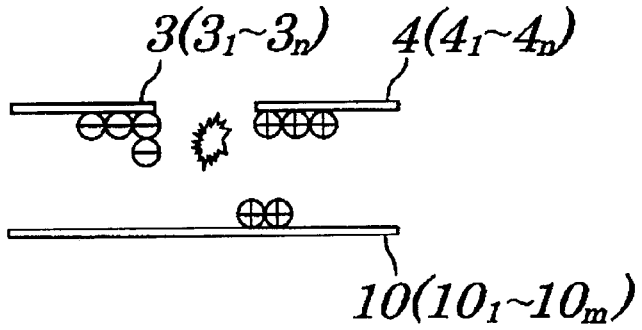
FIG.21B (PRIOR ART)
Figure 21C:
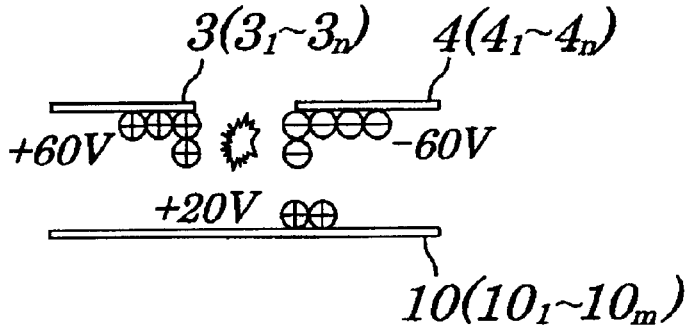
FIG.21C (PRIOR ART)

Then, the driving circuit performs operations to be done within the subfield period SF corresponding to the timing chart shown in FIG. 20, that is, steady operations. The timing chart shown in FIG. 3 differs from that shown in FIG. 20 in that the bias voltage $V_{sw}$ is applied to all the sustaining electrodes $\mathbf{4}_1$ to $\mathbf{4}_n$. That is, it is at this point that the bias voltage $V_{sw}$ is applied to all the sustaining electrodes $\mathbf{4}_1$ to $\mathbf{4}_n$.

Figure 16:
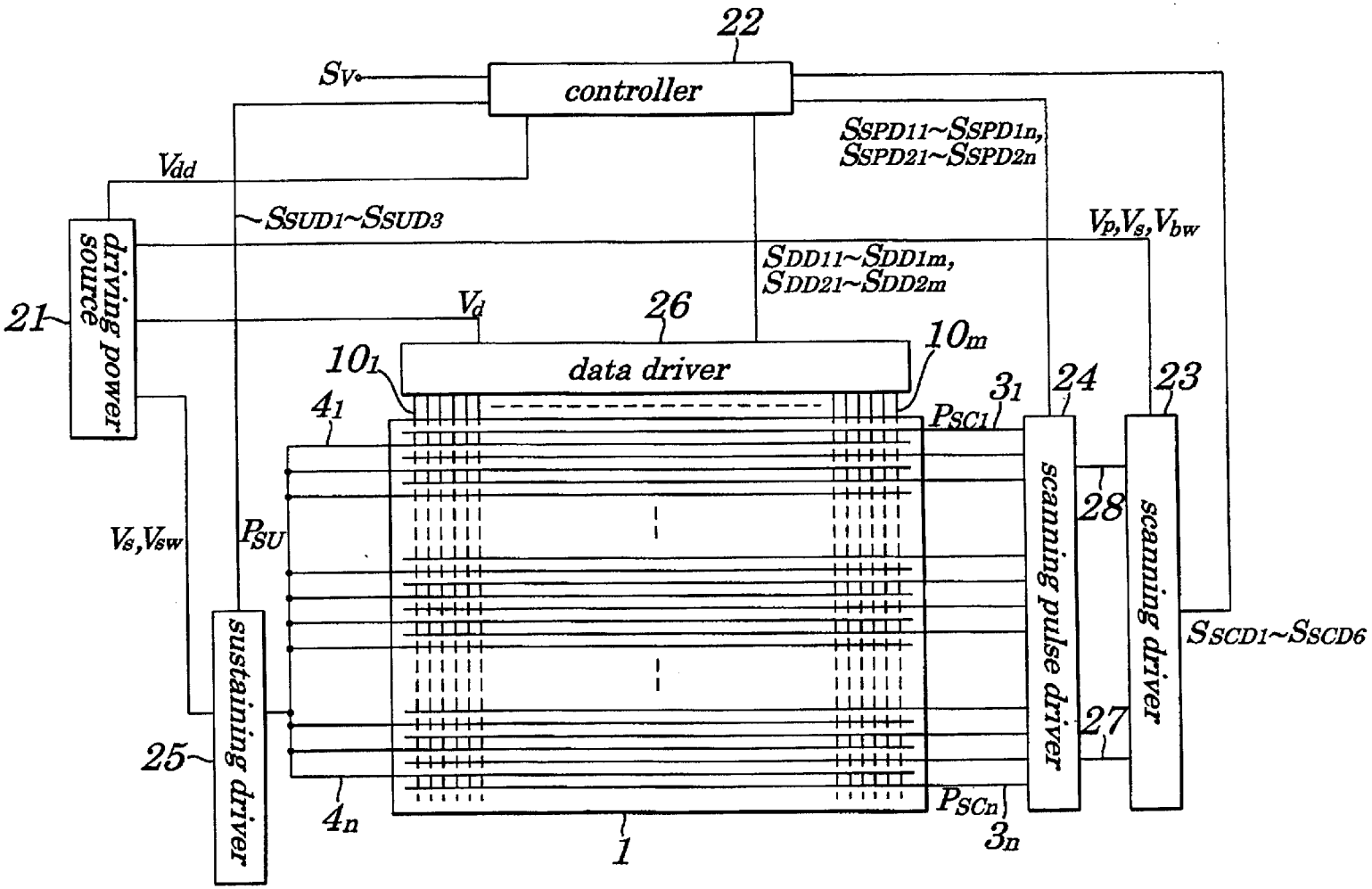
FIG. 16 (PRIOR ART)
FIG. 16 is a schematic block diagram showing an example of configurations of a driving circuit of the conventional AC driving surface-discharge type PDP.

Moreover, in the description of the conventional technology, the operations performed immediately after the power-ON are explained by referring to FIG. 20 wherein the controller 22 shown in FIG. 16 produces, in order to display the black color on the entire PDP 1, the high-level data driver control signals $S_{DD21}$ to $S_{DD2m}$ (not shown) and feeds them to the data driver 26. In the steady operations, the controller 22 feeds, in order to perform writing of image information, based on the video signal to each of the display cell of the PDP 1 for every line, at the address period $T_A$, with predetermined timing, the low-level data driver control signals $S_{DD11}$ to $S_{DD1m}$ and the high-level data driver control signals $S_{DD21}$ to $S_{DD2m}$ to the data driver 26.

In the present invention, contents of the steady operations are the same as those in the conventional technology described above, their descriptions are omitted.

Thus, in the embodiment of the present invention, while the sustaining voltage $V_s$ to be fed from the driving power source 21, priming voltage $V_p$, the scanning base voltage $v_{bw}$, the bias voltage $V_{sw}$, and the data voltage $V_d$ have not yet reached the predetermined voltage due to the time immediately after the power-ON, the wall charges being resided on the display cell are erased as much as possible by the application of the first charge erasing pulse $P_{EEN1}$ to the scanning electrode 3 ($\mathbf{3}_1$–$\mathbf{3}_n$). Moreover, since the priming voltage $V_p$ is not applied to the scanning electrode 3 ($\mathbf{3}_1$–$\mathbf{3}_n$) and since the bias voltage $V_{sw}$ is not applied to the sustaining electrode 4 ($\mathbf{4}_1$–$\mathbf{4}_n$), even when the residual wall charges have been accumulated in some display cells in the PDP 1 at the previous time of the power-OFF and irrespective of the characteristic of the driving power source 21, the residual wall charges can be completely erased and, therefore, there is no fear that the display cell emits light erroneously causing a useless display in the PDP 1.

Second Embodiment

Figure 5:
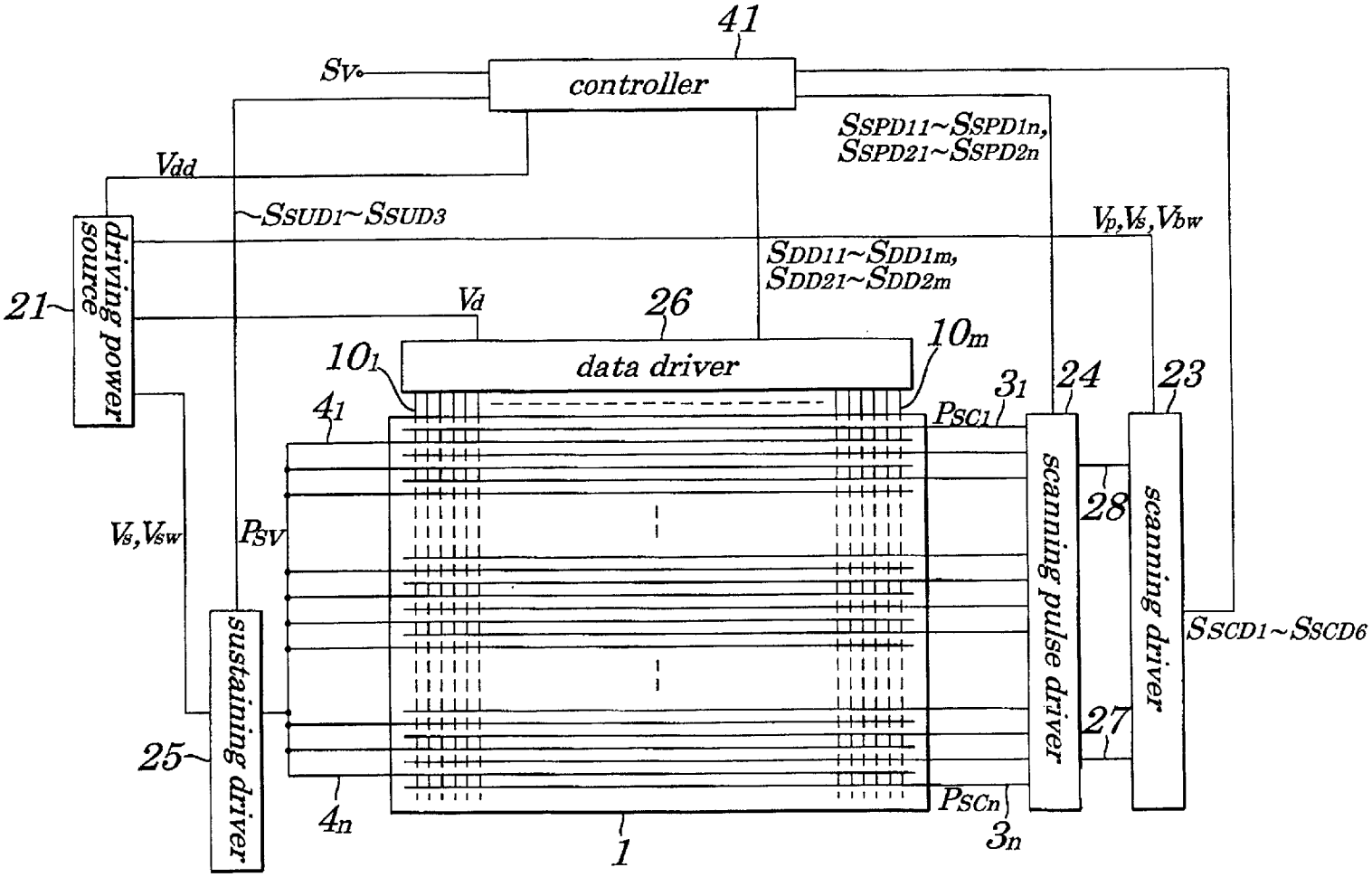
FIG. 5 is a schematic block diagram showing configurations of a driving circuit of a PDP according to a second embodiment of the present invention.

FIG. 5 is a schematic block diagram for showing configurations of a driving circuit of a PDP 1 according to a second embodiment of the present invention. In FIG. 5, same reference numbers are assigned to corresponding parts having the same functions in FIG. 1 and their descriptions are omitted accordingly. In the PDP 1 shown in FIG. 5, instead of a controller 31, a controller 41 is newly provided. The controller 41 has the same configurations as those of the controller 31. Functions of the controller 41 are the same as those in the controller 31. Types of control signals produced by the controller 41 based on a video signal $S_v$ fed from the outside and output to other units are the same as those of the controller 31 shown in FIG. 1, however, waveforms of the control signals employed in the controller 41 are different from those employed in the controller 31. Details of waveforms of each of signals employed in the second embodiment will be explained later.

Figure 6:
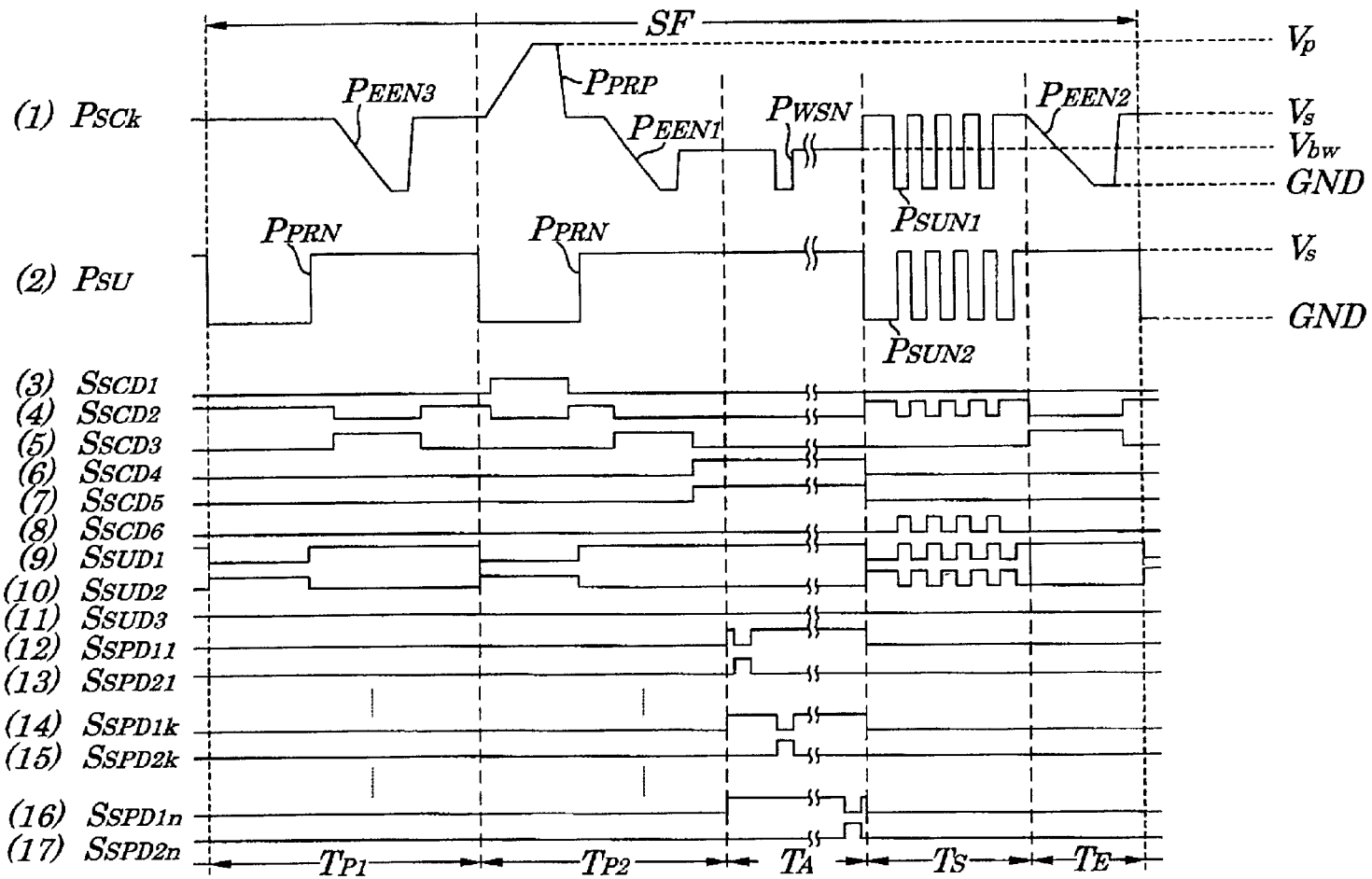
FIG. 6 is a timing chart showing one example of operations of the driving circuit performed immediately after power-ON according to the second embodiment of the present invention.

Next, operations of the driving circuit in the PDP 1 performed immediately after power-ON are described by referring to a timing chart shown in FIG. 6. In the timing chart shown in FIG. 6, a subfield period SF occurring for several tens of periods immediately after the power-ON is made up of a first priming period $T_{P1}$ and a second priming period $T_{P2}$, an address period $T_A$, a sustaining period $T_s$, and a charge erasing period $T_E$. However, amplitudes of a pulse $P_{sck}$ (k is a natural number and $1 \leqq k \leqq n$), shown in (1) in FIG. 6, to be fed to a scanning side and of a sustaining pulse $P_{SU}$ shown in (2) in FIG. 6 are determined in a relative manner and, since states of these signals are obtained immediately after power-ON, voltage values of a sustaining voltage $V_s$, priming voltage $V_p$, and bias voltage $V_{sw}$ are transitory ones which have not yet reached predetermined values. In this description of the second embodiment, let it be assumed, as shown in FIG. 4A, that, when power is turned OFF, electric charges being equivalent to a voltage of −50 of negative polarity reside on a scanning electrode 3 ($3_1$–$3_n$) making up a display cell, electric charges being equivalent to a voltage of 30 Volts of positive polarity reside on a sustaining electrode 4 ($4_1$–$4_n$) also making up the display cell, and electric charges being equivalent to a voltage of 30 Volts of positive polarity reside on a data electrode 10 ($10_1$–$10_m$) also making up the display cell and that a potential difference caused by wall charges between the scanning electrode 3 ($3_1$–$3_n$) and sustaining electrode 4 ($4_1$–$4_n$) being adjacent to each other is −80 Volts.

As shown in FIG. 6, when power is ON, a driving power source 21 (FIG. 5) first starts feeding a logic voltage $V_{dd}$ to the controller 41. Then, the controller 41, after having initialized its internal circuits, produces, based on the video signal $S_V$ to be fed from the outside, scanning driver control signals $S_{SCD1}$ to $S_{SCD6}$ shown in (3) to (8) in FIG. 6, sustaining driver control signals $S_{SUD1}$ to $S_{SUD3}$ shown in (9) to (11) in FIG. 6, scanning pulse driver control signals $S_{SPD11}$ to $S_{SPD1n}$ shown in (12) to (17) in FIG. 6, high-level data driver control signals $S_{DD11}$ to $S_{DD1m}$ used to cause a black color to be displayed on the entire of the PDP 1 and the low-level data driver control signals $S_{DD21}$ to $S_{DD2m}$, used also to cause the black color to be displayed on the entire of the PDP 1 and then starts feeding each of the corresponding control signals to each of a scanning driver 23 (sustaining driver 25, scanning pulse driver 24, and data driver 26.

Next, the driving power source 21, when a few hundred milliseconds have elapsed after having started feeding the logic voltage $V_{dd}$ to the controller 41, begins feeding sustaining voltage $V_s$, priming voltage $V_p$, scanning base voltage $V_{bw}$, bias voltage $V_{sw}$, and data voltage $V_d$ to each of the scanning driver 23, sustaining driver 25, and data driver 26. As a result, during the first priming period $T_{p1}$, since a switch $\mathbf{25}_2$ of a sustaining driver 25 is turned ON (see FIG. 18) in response to a high-level sustaining driver control signal $S_{SUD2}$ (see (10) in FIG. 6) and, since a switch $\mathbf{23}_2$ of a scanning driver 23 has been turned ON (see FIG. 17) in response to a high-level scanning driver control signal $S_{SCD2}$ (see (4) in FIG. 6) that had been fed immediately before a start of the subfield period SF, as shown in FIG. 6, all scanning electrodes $\mathbf{3}_1$ to $\mathbf{3}_n$ are held at the sustaining voltage $V_s$ and a priming pulse $P_{PRN}$ of negative polarity shown in (2) in FIG. 6 is applied to all sustaining electrodes $\mathbf{4}_1$ to $\mathbf{4}_n$. That is, though the sustaining voltage $V_s$ is applied between the scanning electrodes $\mathbf{3}_1$ to $\mathbf{3}_u$ and sustaining electrodes $\mathbf{4}_1$ to $\mathbf{4}_n$ in all display cells, no voltage required for priming discharge is applied and, as a result, no priming discharge occurs in a discharging gas space 14 (not shown) in a vicinity of a gap between the scanning electrodes $\mathbf{3}_1$ to $\mathbf{3}_n$ and the sustaining electrodes $\mathbf{4}_1$ to $\mathbf{4}_n$ in all the display cells.

Next, when the high-level sustaining driver control signal $S_{SUD2}$ (see (10) in FIG. 6) goes low, the switch $\mathbf{25}_2$ of the sustaining driver 25 is turned ON (see FIG. 18) and, at the same time, a switch $\mathbf{25}_1$ of the sustaining driver 25 is turned ON (see FIG. 17) when the high-level sustaining driver control signal $S_{SUD1}$ (see (9) in FIG. 2) goes high. Then, a switch $\mathbf{23}_3$ of the scanning driver 23 is turned ON (see FIG. 17) in response to the scanning driver control signal $S_{SCD3}$ (see (5) in FIG. 6) and, therefore, after all the sustaining electrodes $\mathbf{4}_1$ to $\mathbf{4}_n$ are held at the sustaining voltage $V_s$ of about 180 Volts, a third charge erasing pulse $P_{EEN3}$ of negative polarity is applied to all the scanning electrodes $\mathbf{3}_1$ to $\mathbf{3}_n$ in (1) in FIG. 6.

Therefore, in the display cell on which residual wall discharges are accumulated, in a state in which there is the potential difference of −80 Volts caused by the residual wall charges between the scanning electrode 3 ($3_1$–$3_n$) and sustaining electrode 4 ($4_1$–$4_n$) being adjacent to each other, since the sustaining electrode 4 ($4_1$–$4_n$) is held at the sustaining voltage V, of about 180 Volts and, moreover, the third charge erasing pulse $P_{EEN3}$ of 0 Volts of negative polarity is applied to the scanning electrode 3 (31–3n) and, therefore, a voltage of about 260 Volts in total is applied between the scanning electrode 3 ($3_1$–$3_n$) and sustaining electrode 4 ($4_1$–$4_n$).

Thus, the voltage between the scanning electrode 3 ($3_1$–$3_n$) and sustaining electrode 4 ($4_1$–$4_n$) exceeds the discharge starting voltage of 220 Volts and, as shown in FIG. 4B, feeble discharge occurs and, as a result, as shown in FIG. 4C, wall charges of negative polarity on the scanning electrode 3 ($3_1$–$3_n$) and wall charges of polarity on the sustaining electrode 4 ($4_1$–$4_n$) are somewhat erased. In the example shown in FIG. 4C, electric charges being equivalent to a voltage of −20 Volts of negative polarity reside on the scanning electrode 3 ($3_1$–$3_n$), electric charges being equivalent to a voltage of 10 Volts of positive polarity reside on the sustaining electrode 4 ($4_1$–$4_n$) and electric charges being equivalent to a voltage of 20 Volts of positive polarity reside on the data electrode 10 ($10_1$–$10_m$) and therefore a potential difference caused by the wall charges between the scanning electrode 3 ($3_1$–$3_n$) and sustaining electrode 4 ($4_1$–$4_n$) being adjacent to each other is −30 Volts. Moreover, in other display cells on which the residual wall charges have not been accumulated, since only the sustaining voltage $V_s$ of about 180 Volts is applied between the scanning electrode 3 ($3_1$–$3_n$) and sustaining electrode 4 ($4_1$–$4_n$) and since this voltage does not exceed the discharge starting voltage 220 Volts, no discharge occurs.

Next, in a second priming period $T_{P2}$, since a switch $\mathbf{23}_1$ of the scanning driver 23 is turned ON (see FIG. 17) in response to the high-level scanning driver signal $S_{SCD1}$ (see (3) in FIG. 6) and, at the same time, the switch $\mathbf{25}_2$ of the sustaining driver 25 is turned ON (see FIG. 18) in response to the high-level sustaining driver control signal $S_{SUD2}$ (see (10) in FIG. 6), a priming pulse $\mathbf{7}_{PRP}$ of positive polarity shown in (1) in FIG. 6 is applied to all scanning electrodes $\mathbf{3}_1$ to $\mathbf{3}_n$ and the priming pulse $P_{PRN}$ of negative polarity shown in (2) in FIG. 6 is applied to all the sustaining electrodes $\mathbf{4}_1$ to $\mathbf{4}_n$. Therefore, priming discharge occurs in the discharging gas space 14 in the vicinity of a gap between the scanning electrodes $\mathbf{3}_1$ to $\mathbf{3}_n$ and the sustaining electrodes $\mathbf{4}_1$ to $\mathbf{4}_n$, which causes active particles inducing easy occurrence of discharging in the display cell to be produced and causes wall charges of negative polarity to be-accumulated on the scanning electrodes $\mathbf{3}_1$ to $\mathbf{3}_n$ and wall charges of positive polarity to be also accumulated on the sustaining electrodes $\mathbf{4}_1$ to $\mathbf{4}_n$.

Next, the switch $\mathbf{25}_2$ of the sustaining driver 25 is turned OFF (see FIG. 18) when the high-level sustaining driver control signal $S_{SUD2}$ (see (10) in FIG. 6) goes low and, at the same time, the switch $\mathbf{25}_1$ of the sustaining driver 25 is turned ON (see FIG. 18) when the low-level sustaining driver control signal $S_{SUD1}$ (see (9) in FIG. 6). Then, since the switch $\mathbf{23}_3$ of the scanning driver 23 is turned ON (see FIG. 17) in response to the high-level scanning driver control signal $S_{SCD3}$ (see (5) in FIG. 6), after all the sustaining electrodes $\mathbf{4}_1$ to $\mathbf{4}_n$ have been held at a voltage of about 180 Volts, a first charge erasing pulse $P_{EEN1}$ of negative polarity shown in (1) in FIG. 6 is applied to all the scanning electrodes $\mathbf{3}_1$ to $\mathbf{3}_n$. Therefore, feeble discharging occurs in all the display cells, which causes the wall charges of negative polarity on the scanning electrodes $3_1$ to $3_n$ and the wall charges of positive polarity on the sustaining electrodes $4_1$ to $4_n$ to be completely erased. Hereafter, in the address period $T_A$, sustaining period $T_s$, and charge erasing period $T_E$, the same operation as described by referring to FIG. 2 in the above embodiment are performed. Then, the driving circuit, after having performed operations to be done within one subfield SF period for several tens of periods, as in the case of the above first embodiment, performs operations to be done in the subfield period SF corresponding to the timing chart shown in FIG. 3 during one period and operations in the subfield period SF corresponding to the timing chart shown in FIG. 20, that is, steady operations.

Thus, according to configurations in the second embodiment, during a second priming period $T_{P2}$, since the priming pulse $P_{PRN}$ is applied between all the scanning electrodes $3_1$ to $3_n$ and all the sustaining electrodes $4_1$ to $4_n$, the wall charges of negative polarity on the scanning electrode 3 ($3_1$–$3_n$) making up the display cell in which the residual wall charges are accumulated and the wall charges of negative polarity on the sustaining electrode 4 ($4_1$–$4_n$) are erased more when compared with the first embodiment and states of charges of all the display cells making up the PDP 1 are made uniform. The danger that the display cell emits light erroneously immediately after the power-ON which causes useless display on the PDP 1 decreases more when compared with the case in the first embodiment.

Third Embodiment

Figure 7:
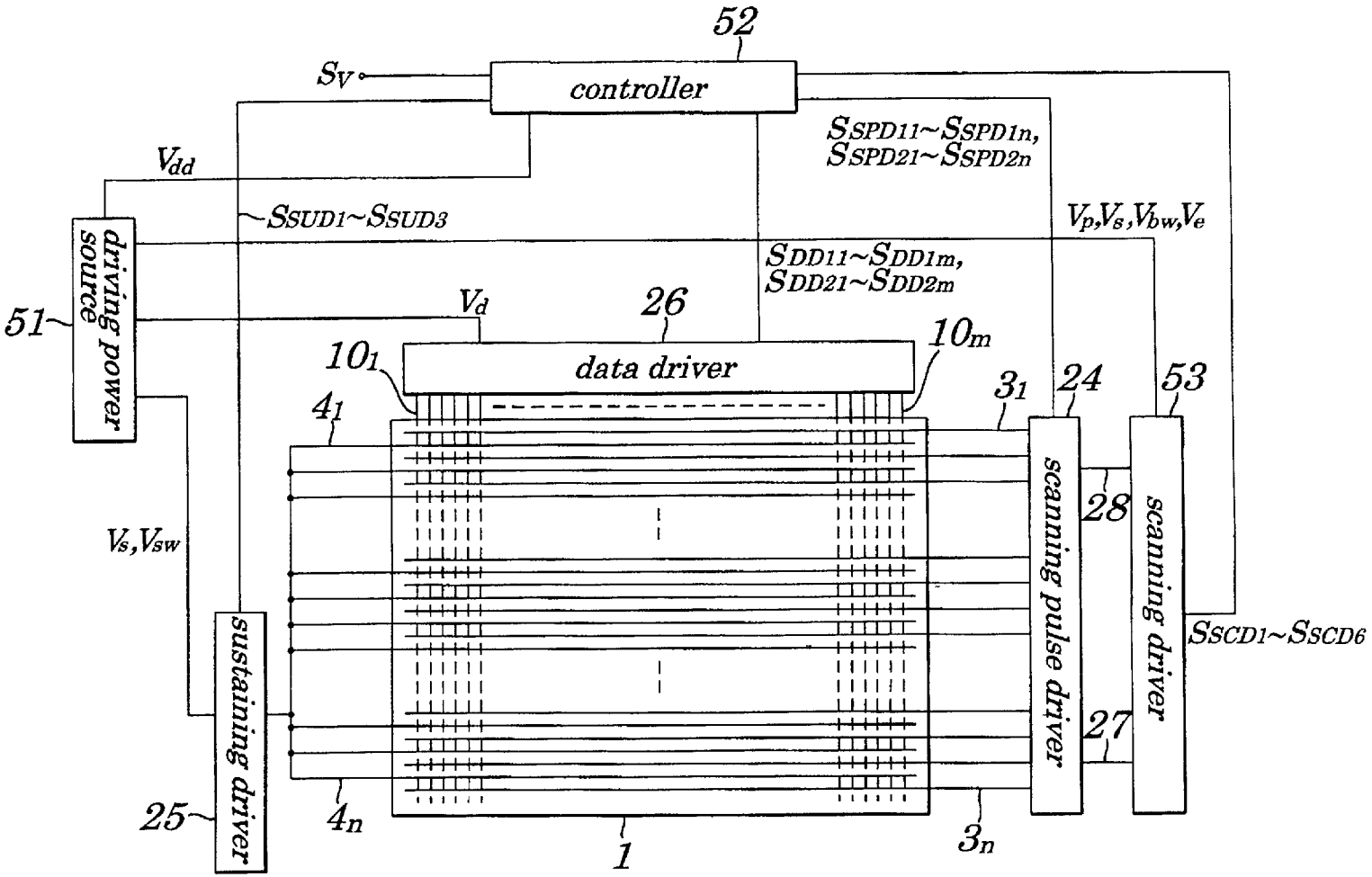
FIG. 7 is a schematic block diagram showing configurations of a driving circuit of a PDF according to a third embodiment of the present invention.

FIG. 7 is a schematic block diagram showing configurations of a driving circuit of a PDP 1 according to a third embodiment of the present invention. In FIG. 7, same reference numbers are assigned to corresponding parts having the same functions as those in FIG. 1 and their description is omitted accordingly. In the driving circuit of the PDP 1 shown in FIG. 7, instead of a driving power source 21, a controller 31, and a scanning driver 23, a driving power source 51, a controller 52, and a scanning driver 53 are newly provided.

The driving power source 51 has a function, in addition to functions that the driving power source 21 has, of producing a charge erasing voltage Ve of about −40 Volts based on a sustaining voltage $V_s$ and feeding it to the scanning driver 53. The controller 52 has a function, in addition to functions that the controller 31 has, of producing a scanning driver control signal $S_{SCD7}$ based on the video signal $S_v$ fed from the outside and of feeding it to the scanning driver 53. Moreover, though the controller 52 outputs control signals of the same kind as that of other control signals that the controller 31 outputs, their waveforms are partially different. Concrete waveforms of each of the control signals will be described in detail below.

Figure 8:
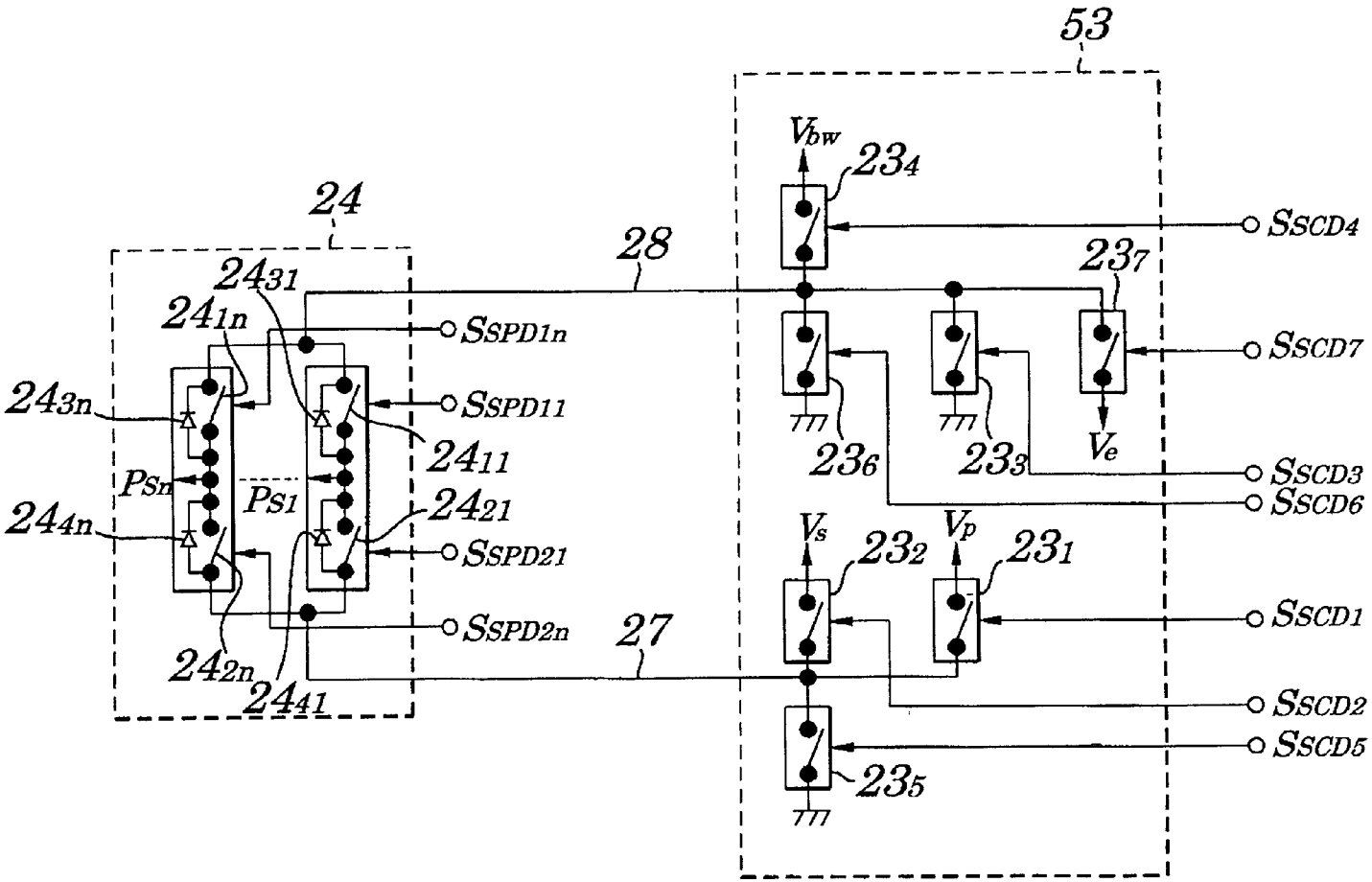
FIG. 8 is a schematic block diagram showing configurations of a scanning driver and a scanning pulse driver making up the driving circuit of the PDP according to the third embodiment of the present invention.

FIG. 8 is a schematic block diagram showing configurations of the scanning driver 53 and a scanning pulse driver 24 making up the driving circuit of the PDP 1 according to the third embodiment. In FIG. 8, same reference numbers are assigned to corresponding parts having the same functions as those in FIG. 17 and their descriptions are omitted accordingly. In the scanning driver 53, a switch $23_7$ is newly provided. One terminal of the switch $23_7$ is connected to a negative line 28 and another terminal of the switch $23_7$ is supplied with a charge erasing voltage $V_e$ of −40 Volts and is turned ON/OFF based on a scanning driver control signal $S_{SCD7}$ fed from the controller 52 and applies a voltage having a predetermined waveform to the scanning pulse driver 24 though the negative line 28.

Figure 9:
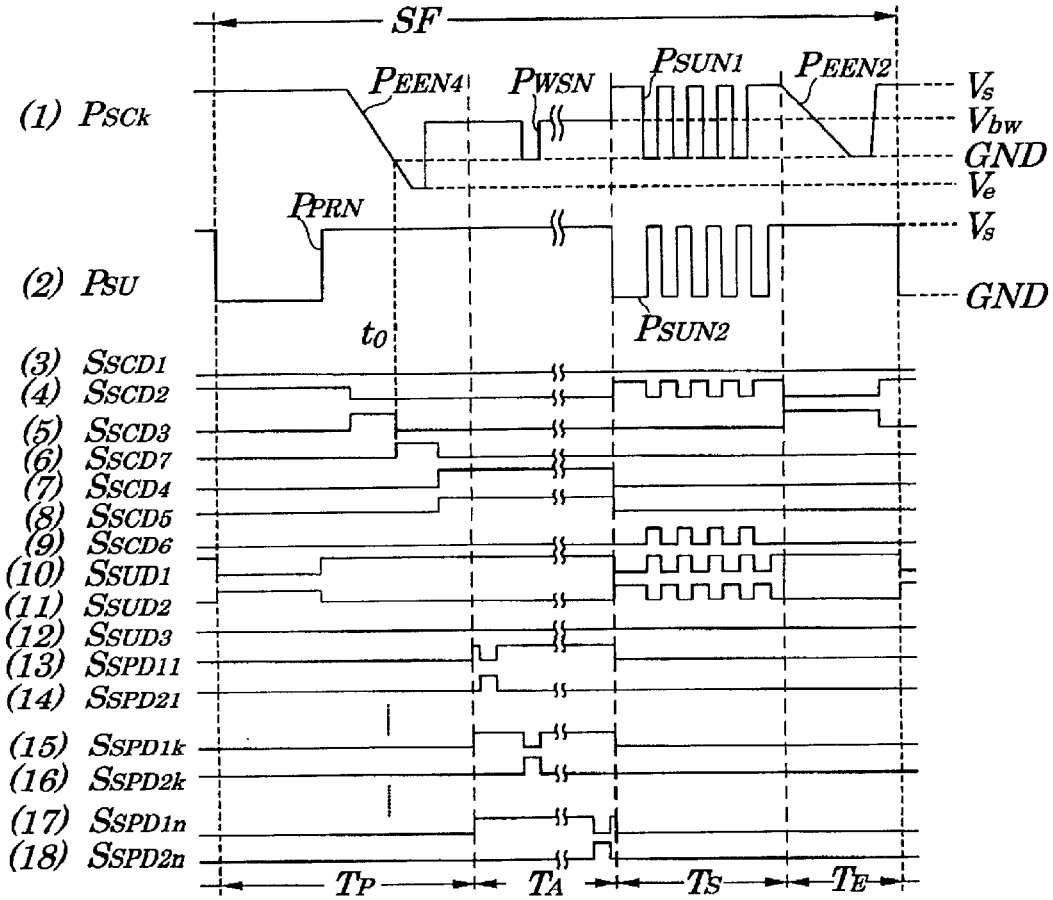
FIG. 9 is a timing chart showing one example of operations of the driving circuit performed immediately after power-ON according to the third embodiment of the present invention.

Next, operations of the driving circuit of the PDP 1 performed immediately after the power-ON will be explained by referring to a timing chart shown in FIG. 9. Amplitudes of a pulse $P_{SCk}$ (k is a natural number and $1 \leqq k \leqq n$) shown in (1) in FIG. 9, to be fed to a scanning side and a sustaining pulse $P_{SU}$ shown in (2) in FIG. 9 are determined in a relative manner and, since waveforms of these signals are ones obtained immediately after a supply of power, a voltage values of the sustaining voltage $V_s$, priming voltage $V_p$, bias voltage $V_{sw}$, the charge erasing voltage $V_e$ are transitory ones which have not yet reached predetermined values. Moreover, in the description of the first embodiment, let it be assumed, as shown in FIG. 4A, that, when the power is turned OFF a previous time, electric charges being equivalent to a voltage of −50 of negative polarity reside on a scanning electrode 3 ($3_1$–$3_n$) making up the display cell, electric charges being equivalent to a voltage of 30 Volts of positive polarity reside on a sustaining electrode 4 ($4_1$–$4_n$) also making up the display cell, and electric charges being equivalent to a voltage of 30 Volts of positive polarity reside on a data electrode 10.($10_1$–$10_m$) also making up the display cell and that a potential difference caused by wall charges between the scanning electrode 3 ($3_1$–$3_n$) and the sustaining electrode 4 ($4_1$–$4_n$) being adjacent to each other is −80 Volts.

When the power is turned ON, the driving power source 51 starts feeding a logic voltage $V_{dd}$ to the controller 52. Then, the controller 52, after having initialized its internal circuits, produces, based on the video signal $S_v$ to be fed from the outside, scanning driver control signals $S_{SCD1}$ to $S_{SCD7}$ shown in (3) to (9) in FIG. 9, sustaining driver control signals $S_{SUD1}$ to $S_{SUD3}$ shown in (10) to (12) in FIG. 9, scanning pulse driver control signals $S_{SPD11}$ to $S_{SPD1n}$ and $S_{SPD21}$ to $S_{SPD2n}$ shown in (13) to (18) in FIG. 9 (not shown partly), high-level data driver control signals $S_{DD11}$ to $S_{DD1m}$ (shown in FIG. 7) used to cause a black color to be displayed on the entire PDP 1 and low-level data driver control signals $S_{DD21}$ to $S_{DD2m}$ (shown in FIG. 7) used also to cause black color to be displayed on the entire of the PDP 1 and then starts feeding each of the corresponding control signals to each of the scanning driver 53, a sustaining driver 25, the scanning pulse driver 24, and a data driver 26.

Next, the driving power source 51, when a few hundred milliseconds elapsed after having started feeding the logic voltage $V_{dd}$ to the controller 52, starts feeding the sustaining voltage $V_s$, a priming voltage $V_p$, a scanning base voltage $V_{bw}$, bias voltage $V_{sw}$, charge erasing voltage $V_e$, and a data voltage $V_d$ to each of the scanning driver 53, the sustaining driver 25 and the data driver 26.

As a result, during a priming period $T_p$, since a switch $25_2$ of the sustaining driver 25 is turned ON (see FIG. 18) in response to the high-level sustaining driver control signal $S_{SUD2}$ (see (11) in FIG. 9) and, since a switch $23_2$ of the scanning driver 53 has been turned ON (see FIG. 8) in response to the high-level scanning driver control signal $S_{SCD2}$ (see (4) in FIG. 9) that had been supplied immediately before a start of a subfield SF, as shown in (1) in FIG. 9, all scanning electrodes $3_1$ to $3_n$ are held at the sustaining voltage $V_s$ and a priming pulse $P_{PRN}$ of negative polarity is applied to all sustaining electrodes $4_1$ to $4_n$ in (2) in FIG. 9. That is, though the sustaining voltage $V_s$ is applied between the scanning electrodes $3_1$ to $3_n$ of all display cells and sustaining electrodes $4_1$ to $4_n$ of all display cells, no voltage required for priming discharge is applied and, as a result, no priming discharge occurs in a discharge gas space 14 (not shown) in a vicinity of a gap between the scanning electrodes $3_1$ to $3_n$ of all display cells and the sustaining electrodes $4_1$ to $4_n$ of all display cells. Moreover, in a display cell, even when residual wall charges shown in (1) in FIG. 4 reside on the scanning electrode 3 ($3_1$–$3_n$), sustaining electrode 4 ($4_1$–$4_n$), and data electrode 10 ($10_1$–$10_m$) and, even if a potential difference caused by the wall charge between the scanning electrode 3 ($3_1$–$3_n$) and sustaining electrode 4 ($4_1$–$4_n$) being adjacent to each other, since only the sustaining voltage V, of about 180 Volts is applied between the scanning electrode 3 ($3_1$–$3_n$) and sustaining electrode 4 ($4_1$–$4_n$) and, since the voltage does not exceed the discharge starting voltage (in the example, the voltage is 220 Volts), no discharge occurs.

Then, the switch $25_2$ of the sustaining driver 25 is turned OFF when the high-level sustaining driver control signal $S_{SUD2}$ (see (11) in FIG. 9) goes low and, at the same time, a switch $25_1$ of the sustaining driver 25 is turned ON (see FIG. 18) when the low-level sustaining driver control signal $S_{SUD1}$ (see (10) in FIG. 9) goes high. Then, since a switch $23_3$ of the scanning driver 53 is turned ON (see FIG. 8) in response to the high-level scanning driver control signal $S_{SCD3}$ (see (5) in FIG. 9), after all the sustaining electrodes $4_1$ to $4_n$ has been held at the sustaining voltage V, of about 180 Volts, a fourth charge erasing pulse $P_{EEN4}$ shown in (1) in FIG. 9 starts being supplied to all the scanning electrodes $3_1$ to $3_n$. Potential of all the scanning electrodes $3_1$ to $3_n$ starts dropping from the sustaining voltage $V_s$ of about 180 Volts to 0 Volts.

Then, when the voltages of all scanning electrodes $3_1$ to $3_n$ reach 0 Volts (at the time to in FIG. 9), the switch $23_2$ of the scanning driver 53 is turned OFF when the high-level scanning driver control signal $S_{SCD3}$ (see (5) in FIG. 9) goes low and, at the same time, the switch $23_7$ of the scanning driver 53 is turned ON (see FIG. 8) when the low-level scanning driver control signal $S_{SCD7}$ (see (6) in FIG. 9) goes high and, therefore, the voltages of all scanning electrodes $3_1$ to $3_n$ drop further from 0 Volts to the charge erasing voltage $V_e$ of about −40 Volts.

Therefore, in the display cell on which residual wall discharges are accumulated, in a state in which there is a potential difference of −80 Volts caused by the residual wall charges between the scanning electrode 3 ($3_1$–$3_n$) and sustaining electrode 4 ($4_1$–$4_n$) being adjacent to each other, since the sustaining electrode 4 ($4_1$–$4_n$) is held at the sustaining voltage V, of about 180 Volts and the fourth charge erasing pulse $P_{EEN4}$ of −40 Volts of negative polarity is applied to the scanning electrode 3 ($3_1$–$3_n$), a voltage of about 290 Volts in total is applied between the scanning electrode 3 ($3_1$–$3_n$) and sustaining electrode 4 ($4_1$–$4_n$). The voltage between the scanning electrode 3 ($3_1$–$3_n$) and sustaining electrode 4 ($4_1$–$4_n$) exceeds discharge starting voltage 220 Volts and feeble discharge occurs and, as a result, the wall charges of negative polarity on the sustaining electrode 4 ($4_1$–$4_n$) and the wall charges of positive polarity on the sustaining electrode 4 ($4_1$–$4_n$) are erased more when compared with the first and second embodiments. In other display cells on which the residual wall charges are not accumulated, the sustaining electrode 4 ($4_1$–$4_n$) is held at the sustaining voltage of about 180 Volts and, moreover, since the fourth charge erasing pulse $P_{EEN4}$ of negative polarity is applied to the scanning electrode 3 ($3_1$–$3_n$), a voltage of about 220 Volts being equal to the discharge starting voltage of 220 Volts is applied between the scanning electrode 3 ($3_1$–$3_n$) and sustaining electrode 4 ($4_1$–$4_n$) and, therefore, in some cases, feeble discharge occurs and a very small quantity of charges existing on the scanning electrode 3 ($3_1$–$3_n$) or sustaining electrode 4 ($4_1$–$4_n$) or in the discharge gas space 14 is erased not due to the above residual wall charges but due to other factors.

Thereafter, same operations described by referring to FIG. 2 in the first embodiment are performed during an address period $T_A$, a sustaining period $T_S$, and a charge erasing period $T_E$. Then, the driving circuit, after having carried out the above operations to be done within one subfield period SF for several tens of periods, as in the case of the first embodiment, performs operations to be done within the subfield period SF corresponding to the timing chart shown in FIG. 3 for one period, that is, operations to be done within one subfield period SF, that is, steady operations.

Thus, according to configurations of the third embodiment, during the priming period $T_P$, since the fourth charge erasing pulse $P_{EEN4}$ having its amplitude being larger than that of the first charge erasing pulse $P_{EEN1}$ shown in (1) in FIG. 2 and in (1) in FIG. 6 is applied between all the scanning electrodes $3_1$ to $3_n$ and the sustaining electrodes $4_1$ to $4_2$, the wall charges of negative polarity on the scanning electrode 3 ($3_1$–$3_n$) making up the display cell on which the residual wall charges are accumulated and the wall charges of positive polarity on the sustaining electrode 4 ($4_1$–$4_n$) making up the display cell on which the residual wall charges are accumulated are erased and a very small quantity of charges existing not due to the residual wall charge and but due to other factors, on the scanning electrode 3 ($3_1$–$3_n$) or sustaining electrode 4 ($4_1$–$4_n$) or in the discharge gas space 14 can be also erased more compared with the first and second embodiments. Therefore, there is less danger that the display cell emits erroneously light immediately after the power-ON and that a useless display is produced in the PDP 1 when compared with the cases of the first and second embodiments.

Fourth Embodiment

Figure 10:
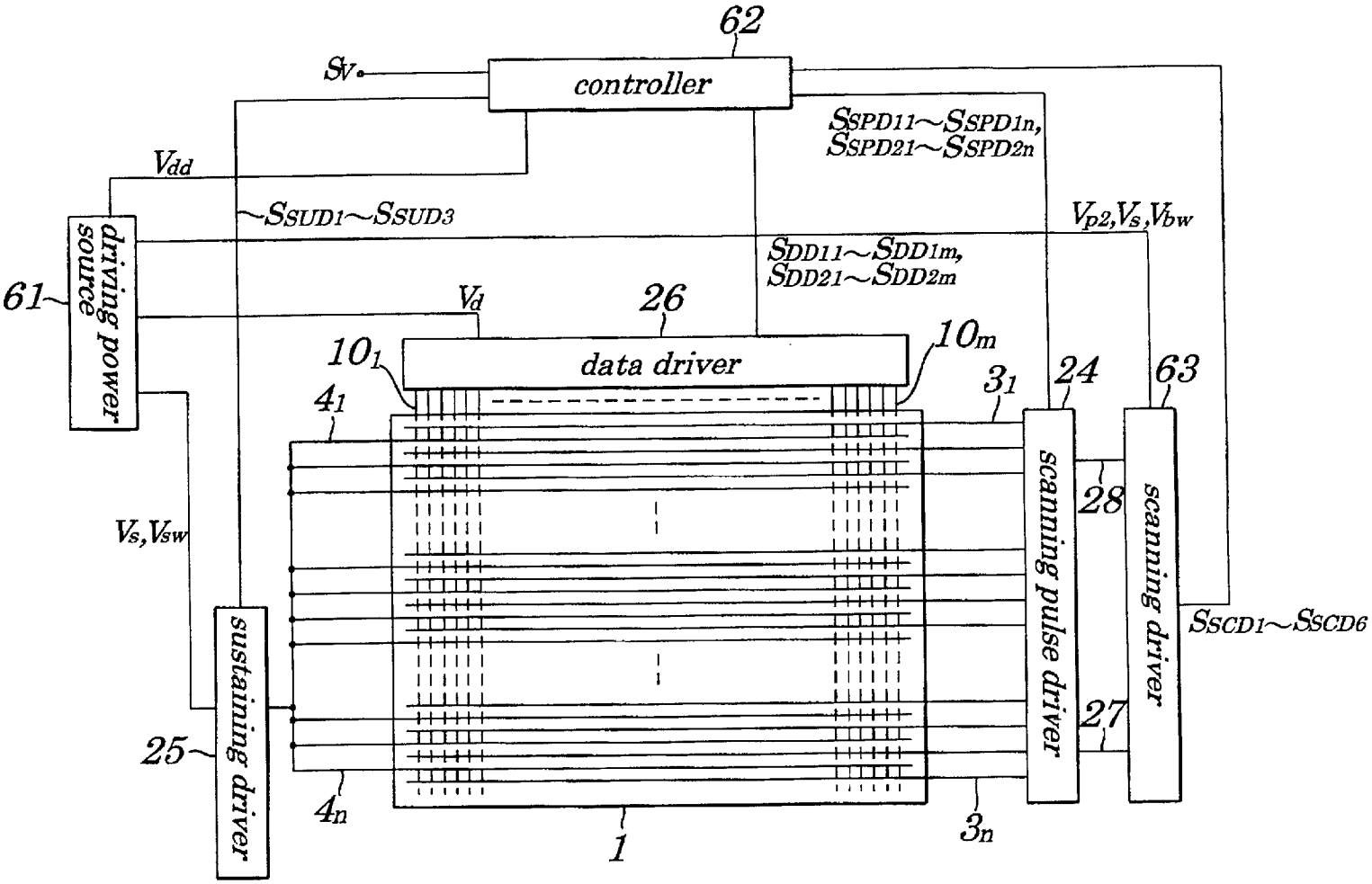
FIG. 10 is a schematic block diagram showing configurations of a driving circuit of a PDP according to a fourth embodiment of the present invention.

FIG. 10 is a schematic block diagram showing configurations of a driving circuit of a PDP 1 according to a fourth embodiment of the present invention. In FIG. 10, same reference numbers are assigned to corresponding parts having the same functions in FIG. 1 and their descriptions are omitted accordingly. In the driving circuit of the PDP 1 in FIG. 10, instead of a driving power source 21, a controller 31 and a scanning driver.23 shown in FIG. 1, a driving power source 61, a controller 62, and a scanning driver 63 are newly provided.

The driving power source 61, in addition to functions that the driving power source 21 has, based on a sustaining voltage $V_S$, produces a second priming voltage $V_{P2}$ of about 440 Volts and feeds it to the scanning driver 63. The controller 62, in addition to functions that the controller 31 has, based on a video signal $S_V$ fed from an outside, produces a scanning driver control signal $S_{SCD8}$ (shown in FIG. 11), and feeds it to the scanning driver 63. The controller 62 outputs control signals of the same kind as that of other control signals that the controller 31 outputs, their waveforms are partially different from each other. Concrete waveforms of each of the control signals will be described in detail below.

Figure 11:
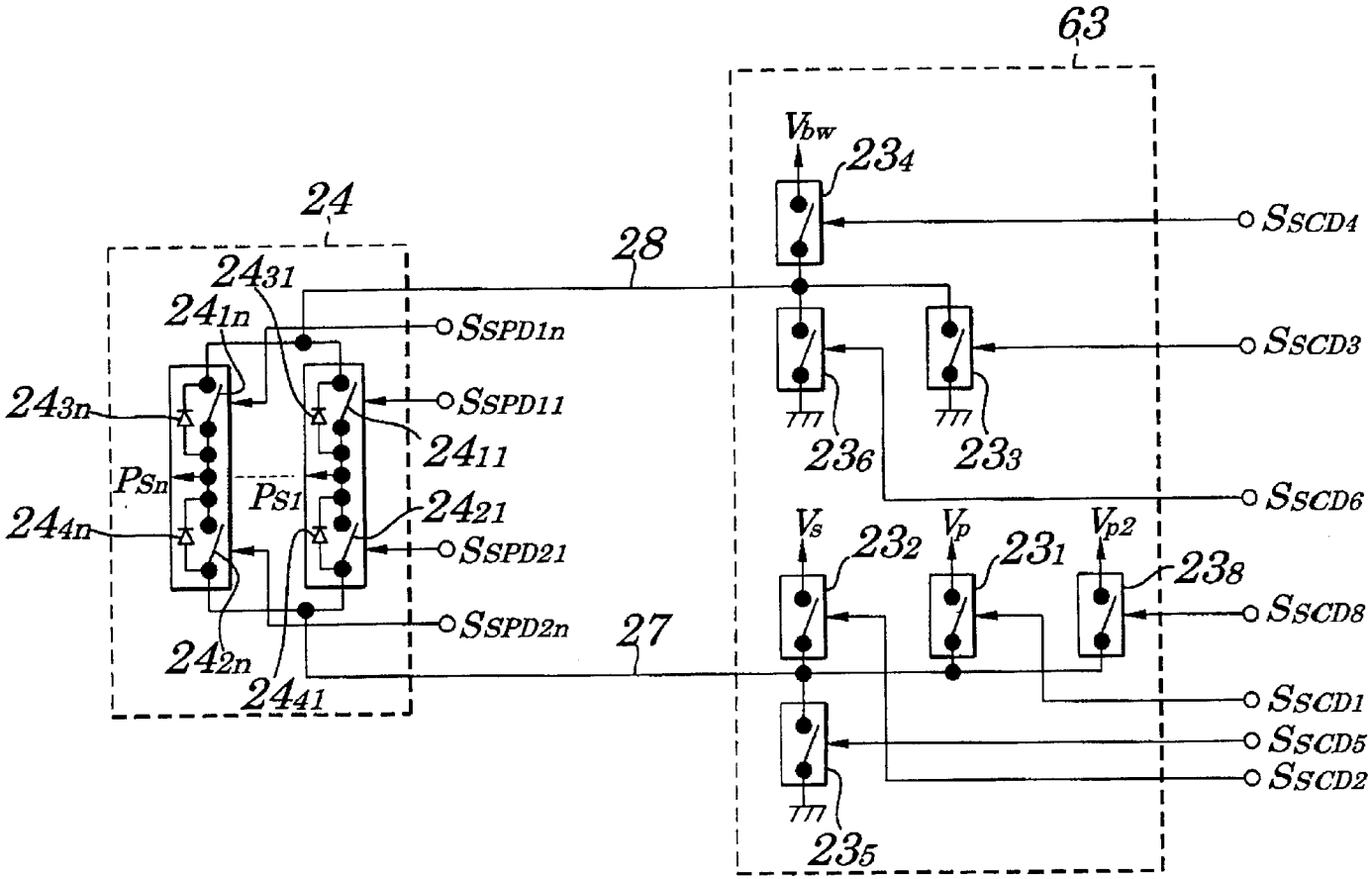
FIG. 11 is a circuit diagram showing configurations of a scanning driver and scanning pulse driver according to the fourth embodiment of the present invention.

FIG. 11 is a circuit diagram showing configurations of the scanning driver 63 and a scanning pulse driver 24 according to the fourth embodiment of the present invention. In FIG. 11, same reference numbers are assigned to corresponding parts having the same functions as those in FIG. 17 and their descriptions are omitted accordingly. In the scanning driver 63 shown in FIG. 11, a switch $23_8$ is newly mounted. The second priming voltage $V_{P2}$ is applied to one terminal of the switch $23_8$ and another terminal of the switch $23_8$ is connected to a positive line 27. The switch $23_8$ is turned ON/OFF based on the scanning driver control signal $S_{SCD8}$ fed from the controller 62 and applies a voltage having a predetermined waveform to the scanning pulse driver 24 through the positive line 27.

Figure 12:
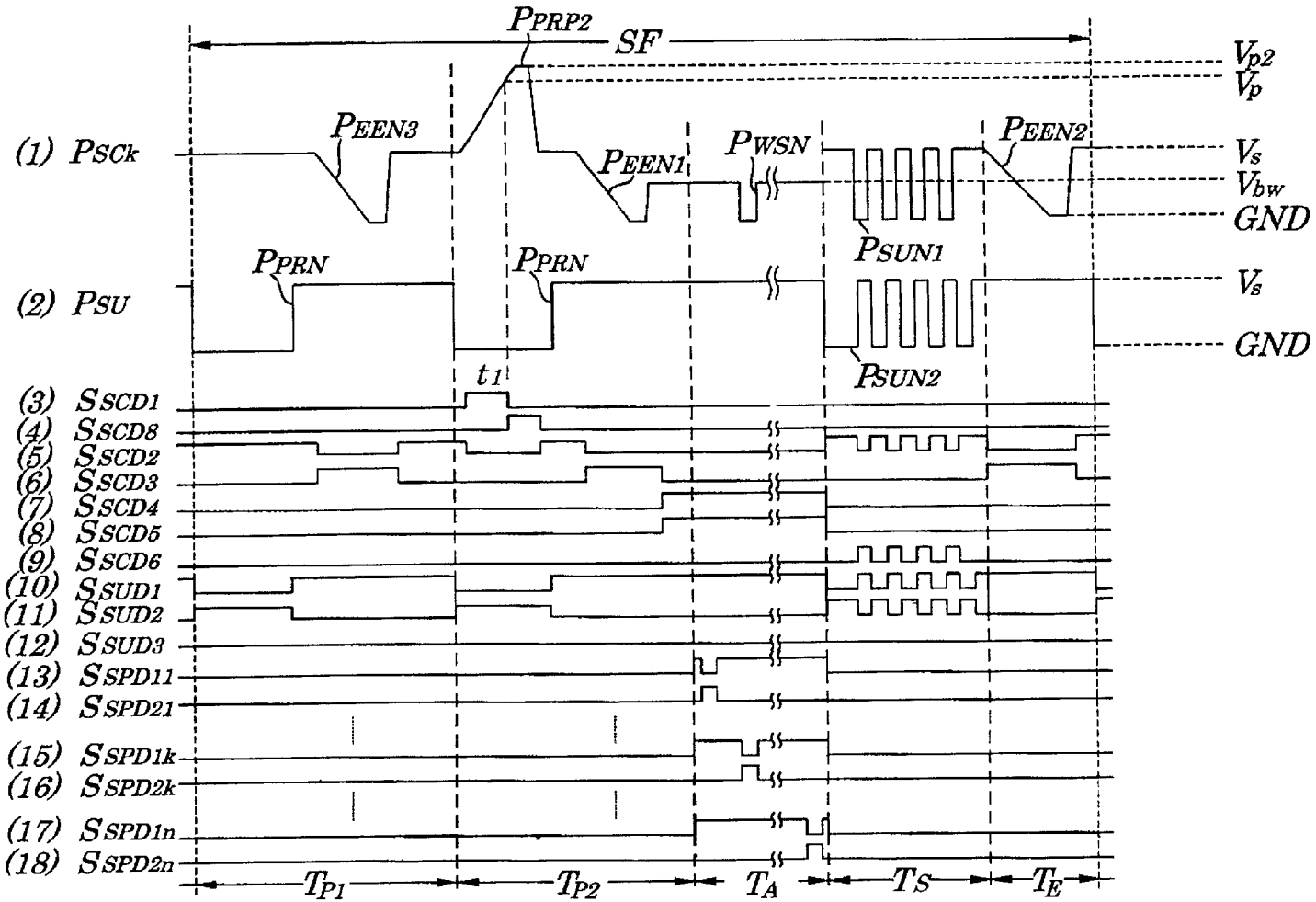
FIG. 12 is a timing chart showing one example of operations performed immediately after power-ON according to the fourth embodiment of the present invention.

Next, operations of the driving circuit of the PDP 1 having the above configuration performed immediately after a power-ON will be described by referring to a timing chart shown in FIG. 12. In the timing chart shown in FIG. 12, a subfield period SF occurring for several tens of periods immediately after the power-ON is made up of a first priming period $T_{P1}$ and a second priming period $T_{P2}$, an address period $T_A$, a sustaining period $T_S$ and a charge erasing period $T_E$. Amplitudes of a pulse $P_{SCk}$ (k is a natural number and $1 \leqq k \leqq n$) shown in (1) in FIG. 12, to be fed to a scanning side and a sustaining pulse $P_{SU}$ shown in (2) in FIG. 12 are determined in a relative manner. Since states of these signals are ones obtained immediately after the power-ON, voltage values of the sustaining voltage $V_S$, a priming voltage $V_P$, the second priming voltage $V_{P2}$, and a bias voltage $V_{sw}$ are transitory ones which have not yet reached predetermined values. In the description of the fourth embodiment, let it be assumed, as shown in FIG. 4A, that, when power is turned OFF, electric charges being equivalent to a voltage of −50 of negative polarity reside on a scanning electrode 3 ($3_1$–$3_n$) making up a display cell, electric charges being equivalent to a voltage of 30 Volts of positive polarity reside on a sustaining electrode 4 ($4_1$–$4_n$) also making up the display cell, and electric charges being equivalent to a voltage of 30 Volts of positive polarity reside on a data electrode 10 ($10_1$–$10_m$) also making up the display cell and that a potential difference caused by wall charges between the scanning electrode 3 ($3_1$–$3_n$) and the sustaining electrode 4 ($4_1$–$4_n$) being adjacent to each other is −80 Volts.

When power is turned ON, the driving power source 61 starts feeding a logic voltage $V_{dd}$ to the controller 62. Then, the controller 62, after having initialized its internal circuits, produces, based on the video signal $S_v$ to be fed from an outside, scanning driver control signals $S_{SCD1}$ to $S_{SCD6}$ shown in (3) to (9) in FIG. 12, sustaining driver control signals $S_{SUD1}$ to $S_{SUD3}$ shown in (10) to (12) in FIG. 12, scanning pulse driver control signals $S_{SPD11}$ to $S_{SPD2n}$ shown in (13) to (18) in FIG. 12 (not shown partly) high-level data driver control signals $S_{DD11}$ to $S_{DD1m}$ (shown in FIG. 10) used to cause a black color to be displayed on the entire PDP 1 and low-level data driver control signals $S_{DD21}$ to $S_{DD2m}$ (shown in FIG. 10) used also to cause the black color to be displayed on the entire of the PDP 1 and then starts feeding each of the corresponding control signals to each of the scanning driver 63, a sustaining driver 25, the scanning pulse driver 24, and a data driver 26.

Next, the driving power source 61, when a few hundred milliseconds have elapsed after having started feeding the logic voltage $V_{dd}$ to the controller 62, begins feeding the sustaining voltage $V_s$, the priming voltage $V_p$, the second priming voltage $V_{p2}$, a scanning base voltage $V_{bw}$, the bias voltage $V_{sw}$ and a data voltage $V_d$ to each of the scanning driver 63, the sustaining driver 25 and the data driver 26.

As a result, during the first priming period $T_{P1}$, since a switch $25_2$ of the sustaining driver 25 is turned ON (see FIG. 18) in response to the high-level sustaining driver control signal $S_{SUD2}$ (see (11) in FIG. 12) and since the switch $23_2$ of the scanning driver 63 has been turned ON (see FIG. 11) in response to the high-level scanning driver control signal $S_{SCD2}$ (see (5) in FIG. 12) that had been supplied immediately before the start of the subfield SF, as shown in (1) in FIG. 12, all scanning electrodes $3_1$ to $3_n$ are held at the sustaining voltage $V_s$ and a priming pulse $P_{PRN}$ of negative polarity is applied to all sustaining electrodes $4_1$ to $4_n$ in (2) in FIG. 12. That is, though the sustaining voltage $V_s$ is applied between the scanning electrodes $3_1$ to $3_n$ of all display cells and sustaining electrodes $4_1$ to $4_n$ of all display cells, the voltage required for priming discharge is not applied and, as a result, no priming discharge occurs in a discharge gas space 14 (not shown) in the vicinity of a gap between the scanning electrodes $3_1$ to $3_n$ of all display cells and the sustaining electrodes $4_1$ to $4_n$ of all display cells.

Moreover, in a display cell, even when the residual wall charges shown in FIG. 4A reside on the scanning electrode 3 ($3_1$–$3_n$), the sustaining electrode 4 ($4_1$–$4_n$), and the data electrode 10 ($10_1$–$10_m$) and even if a potential difference caused by the wall charges between the scanning electrode 3 ($3_1$–$3_n$) and the sustaining electrode 4 ($4_1$–$4_n$) being adjacent to each other is −80 Volts, since only the sustaining voltage $V_s$ of about 180 Volts is applied between the scanning electrode 3 ($3_1$–$3_n$) and the sustaining electrode 4 ($4_1$–$4_n$) and, since the voltage does not exceed the discharge starting voltage (in the example, the voltage is 220 Volts), no discharge occurs.

Next, when the high-level sustaining driver control signal $S_{SUD2}$ (see (11) in FIG. 12) goes low, the switch $25_2$ of the sustaining driver 25 is turned OFF and, at the same time, a switch $25_1$ of the sustaining driver 25 is turned ON (see FIG. 18) when the high-level sustaining driver control signal $S_{SUD1}$ (see (10) in FIG. 12) goes high. Then, since a switch $23_3$ of the scanning driver 63 is turned ON (see FIG. 11) in response to the high-level scanning driver control signal $S_{SCD3}$ (see (6) in FIG. 12), after all the sustaining electrodes $4_1$ to $4_n$ have been held at the sustaining voltage $V_s$ of about 180 Volts, a third charge erasing pulse $P_{EEN3}$ of negative polarity is applied to all the scanning electrodes $3_1$ to $3_n$ in (1) in FIG. 2.

Therefore, in the display cell on which residual wall discharges are accumulated, in a state in which there is a potential difference of −80 Volts caused by the residual wall charges between the scanning electrode 3 ($3_1$–$3_n$) and sustaining electrode 4 ($4_1$–$4_n$) being adjacent to each other, since the sustaining electrode 4 ($4_1$–$4_n$) is held at the sustaining voltage $V_s$ of about 180 Volts and the third charge erasing pulse $P_{EEN3}$ of 0 Volts of negative polarity is applied to the scanning electrode 3 ($3_1$–$3_n$), a voltage of about 260 Volts in total is applied between the scanning electrode 3 ($3_1$–$3_n$) and sustaining electrode 4 ($4_1$–$4_n$). As a result, a voltage between the scanning electrode 3 ($3_1$–$3_n$) and sustaining electrode 4 ($4_1$–$4_n$) exceeds the discharge starting voltage of 220 Volts and, as shown in FIG. 4B, a feeble discharge occurs and, as shown in FIG. 4C, the wall charges of negative polarity on the scanning electrode 3 ($3_1$–$3_n$) and wall charges of positive polarity on the sustaining electrode 4 ($4_1$–$4_n$) are somewhat erased. In the example shown in FIG. 4C, electric charges being equivalent to a voltage of −20 Volts of negative polarity reside on the scanning electrode 3 ($3_1$–$3_n$), electric charges being equivalent to a voltage of 10 Volts of positive polarity reside on the sustaining electrode 4 ($4_1$–$4_n$) and electric charges being equivalent to a voltage of 20 Volts of positive polarity reside on the data electrode 10 ($10_1$–$10_m$) and therefore a potential difference caused by the wall charges between the scanning electrode 3 ($3_1$–$3_n$) and sustaining electrode 4 ($4_1$–$4_n$) being adjacent to each other is −30 Volts. Moreover, in other display cell in which the residual wall charges are not accumulated, since only the sustaining voltage $V_s$ of about 180 Volts is applied between the scanning electrode 3 ($3_1$–$3_n$) and sustaining electrode 4 ($4_1$–$4_n$) and, since this voltage does not exceed the discharge starting voltage 220 Volts, no discharge occurs.

Next, during the second priming period $T_{P2}$, since the switch $\mathbf{25}_2$ of the sustaining driver 25 is turned ON (see FIG. 18) in response to the high-level sustaining driver control signal $S_{SUD2}$ (see (11) in FIG. 12), the priming pulse $P_{PRN}$ of negative polarity shown in (2) in FIG. 6 is applied to all the sustaining electrodes $\mathbf{4}_1$ to $\mathbf{4}_n$. Moreover, since a switch $\mathbf{23}_1$ of the scanning driver 63 is turned ON (see FIG. 11) in response to the scanning driver control signal $S_{SCD1}$ (see (3) in FIG. 12) which rises immediately after the sustaining driver control signal $S_{SUD2}$ has gone high, a second priming pulse $P_{PRP2}$ of positive polarity shown in (1) in FIG. 12 starts to be applied to all the scanning electrodes $\mathbf{3}_1$ to $\mathbf{3}_n$. That is, potential of all the scanning electrodes $\mathbf{3}_1$ to $\mathbf{3}_n$ starts to rise from a level of the sustaining voltage $V_s$ of about 180 Volts to a level of the priming voltage $V_p$ of about 400 Volts.

When the potential of all the scanning electrodes $\mathbf{3}_1$ to $\mathbf{3}_n$ reaches about 400 Volts (at a time $t_1$ in FIG. 12), since the high-level scanning driver control signal $S_{SCD1}$ (see (3) in FIG. 12) goes low, the switch $\mathbf{23}_1$ of the scanning driver 63 is turned OFF when the high-level scanning driver control signal $S_{SCD1}$ (in (3) in FIG. 12) goes low and since the switch $\mathbf{23}_8$ of the scanning driver 63 is turned ON (see FIG. 11) when the low-level scanning driver control signal $S_{SCD8}$ (see (4) in FIG. 12) goes high, a potential of all the scanning electrodes $\mathbf{3}_1$ to $\mathbf{3}_n$ rises further from a level of the second priming voltage $V_{P2}$ to a level of the FL priming voltage $V_{P2}$ of about 440 Volts.

Therefore, priming discharge being stronger compared with that occurring in the above second embodiment occurs in the discharging gas space 14 in the vicinity of a gap between the scanning electrodes $\mathbf{3}_1$ to $\mathbf{3}_n$ and the sustaining electrodes $\mathbf{4}_1$ to $\mathbf{4}_n$, which causes active particles inducing easy occurrence of discharging in the display cell to be produced and causes wall charges of negative polarity to be accumulated on the scanning electrodes $\mathbf{3}_1$ to $\mathbf{3}_n$ and wall charges of positive polarity to be also accumulated on the sustaining electrodes $\mathbf{4}_1$ to $\mathbf{4}_n$. However, a probability is high that these wall charges vanish because self-erasing discharge occurs which did not occur in the second embodiment, when the second priming pulse $P_{PRP2}$ having an amplitude being larger than that of the priming pulse $P_{PRP}$ goes low.

The switch $\mathbf{25}_2$ of the sustaining driver 25 is turned OFF when the high-level sustaining driver control signal $S_{SUD2}$ (see (11) in FIG. 12) goes low and the switch $\mathbf{25}_1$ of the sustaining driver 25 is turned ON (see FIG. 18) when the low level sustaining driver control signal $S_{SUD1}$ (in (10) in FIG. 12) goes high. Then, since the switch $\mathbf{23}_3$ of the scanning driver 63 is turned ON (see FIG. 11) in response to the high level scanning driver control signal $S_{SCD3}$ (see (6) in FIG. 12), after all the sustaining electrodes $\mathbf{4}_1$ to $\mathbf{4}_n$ are held at the sustaining voltage $V_s$ of about 180 Volts, a first charge erasing pulse $P_{EEN1}$ of negative polarity shown in (1) in FIG. 12 is applied to all the scanning electrodes $\mathbf{3}_1$ to $\mathbf{3}_n$. Therefore, in all display cells, feeble discharge occurs which causes the wall charges of positive polarity on the scanning electrodes $\mathbf{3}_1$ to $\mathbf{3}_n$ that have not been erased by the self-erasing discharge and the wall charges of negative polarity on the sustaining electrodes $\mathbf{4}_1$ to $\mathbf{4}_n$ that have not been erased by the self-erasing discharge to be completely erased. Thereafter, same operations described by referring to FIG. 2 in the first embodiment are performed during the address period $T_A$, the sustaining period $T_s$, and the charge erasing period $T_E$.

The driving circuit, after having performed the above operations to be done within one subfield period SF for several tens of periods, as in the case of the first embodiment, performs operations to be done within the subfield period SF corresponding to the timing chart shown in FIG. 3 for one period and operations to be done within one subfield period SF corresponding to the timing chart shown in FIG. 20, that is, steady operation.

Thus, according to configurations of the fourth embodiment, during the second priming period $T_{P2}$, since the priming pulse $P_{PRP2}$ is applied between all the scanning electrodes $\mathbf{3}_1$ to $\mathbf{3}_n$, wall charges of negative polarity on the scanning electrode 3 ($\mathbf{3}_1$–$\mathbf{3}_n$) and wall charges of positive polarity on the sustaining electrode 4 ($\mathbf{4}_1$–$\mathbf{4}_n$), both making up the display cell in which the residual wall charge are accumulated, can be erased more when compared in the case of the second embodiment and states of charges in all the display cells making up the PDP 1 are made uniform. Therefore, there is less danger that the display cell emits erroneously light immediately after the power-ON and that a useless display is produced in the PDP 1 when compared with the case of the second embodiments.

It is apparent that the present invention is not limited to the above embodiments but may be changed and modified without departing from the scope and spirit of the invention. For example, in each of the above embodiments, operations (hereinafter referred to as "wall charge erasing sequence") to be done within one subfield period SF corresponding to the timing chart shown in FIGS. 2, 6, 9, and 12 are performed for several tens of periods, however, the present invention is not limited to this, that is, the wall charge erasing sequence may be performed for at least one period or may be repeated for a predetermined time, for example, for a few hundred milliseconds by giving considerations to a variation in rising characters of the sustaining voltage $V_s$ in driving power sources 21, 51, and 61 until the sustaining voltage $V_s$ reaches a predetermined voltage value. The time can be counted by a timer.

Moreover, the wall charge erasing sequence may not be performed only for one period, that is, it may be performed only during the priming period $T_p$ of each of the wall charge erasing sequences in the first and third embodiments and only during the first priming period $T_{P1}$ and the second priming period $T_{P2}$ in the second and fourth embodiments. In addition, even when the wall charge erasing sequence is repeated for two and more periods, the period may not be fixed and the period for which the wall charge erasing sequence is repeated may be set based on a result obtained by detecting whether the sustaining voltage $V_s$ has reached a predetermined voltage value using a voltage detection circuit or not. By configuring as above, it is possible to speedily move to the steady operation.

Moreover, waveforms of a pulse $P_{SC}$ and sustaining pulse $P_{SU}$ to be applied respectively to the scanning electrode 3 ($\mathbf{3}_1$–$\mathbf{3}_n$) and sustaining electrode 4 ($\mathbf{4}_1$–$\mathbf{4}_n$) are not limited to those shown in FIGS. 2, 3, 6, 9, and 12. Relations between the ground and each pulse are not limited to those shown in FIGS. 2, 3, 6, and 12. That is, until the sustaining voltage $V_s$ reaches the predetermined voltage value, at least the bias voltage $V_{sw}$ (if necessary, also the priming voltage $V_p$) may not be applied before the sustaining voltage $V_s$ is applied between the scanning electrode 3 ($\mathbf{3}_1$–$\mathbf{3}_n$) and sustaining electrode 4 ($\mathbf{4}_1$–$\mathbf{4}_n$). Moreover, until the priming voltage $V_p$ reaches the predetermined voltage, the bias voltage $V_{sw}$ (if necessary, the priming voltage $V_p$) may not be applied before the priming voltage $V_p$ is fed. The period during which application of the bias voltage $V_{sw}$ is stopped may be a period being equivalent to one period of the subfield period SF or may be one period of the priming period $T_p$.

Also, the subfield period SF may not be provided with the charge erasing period $T_E$. In each of the above embodiments, the configurations may be combined so long as it is possible. For example, in the second embodiment, instead of the third charge erasing pulse $P_{EEN3}$ shown in (1) in FIG. 6, the fourth charge erasing pulse $P_{EEN4}$ shown in (1) in FIG. 9 may be used. In the fourth embodiment, instead of the third charge erasing pulse $P_{EEN3}$ shown in (1) in FIG. 12, the fourth charge erasing pulse $P_{EEN4}$ shown in (1) in FIG. 9 may be used.

Also, in each of the above embodiments, examples are shown in which the present invention is applied to the PDP 1 where the surface discharge occurs between the scanning electrode 3 ($3_1$–$3_n$) and sustaining electrode 4 ($4_1$–$4_n$) being adjacent to each other, however, the present invention is not limited to this, but may be applied to a PDP disclosed, for example, in Japanese Laid-open Patent Application No. Hei 11-65518 in which a plurality of scanning electrodes and sustaining electrodes each being disposed alternately in a parallel manner and each having a both side discharge electrode structure in which each of the electrodes is so structured as to straddle upper and lower pixels.

Figure 13:
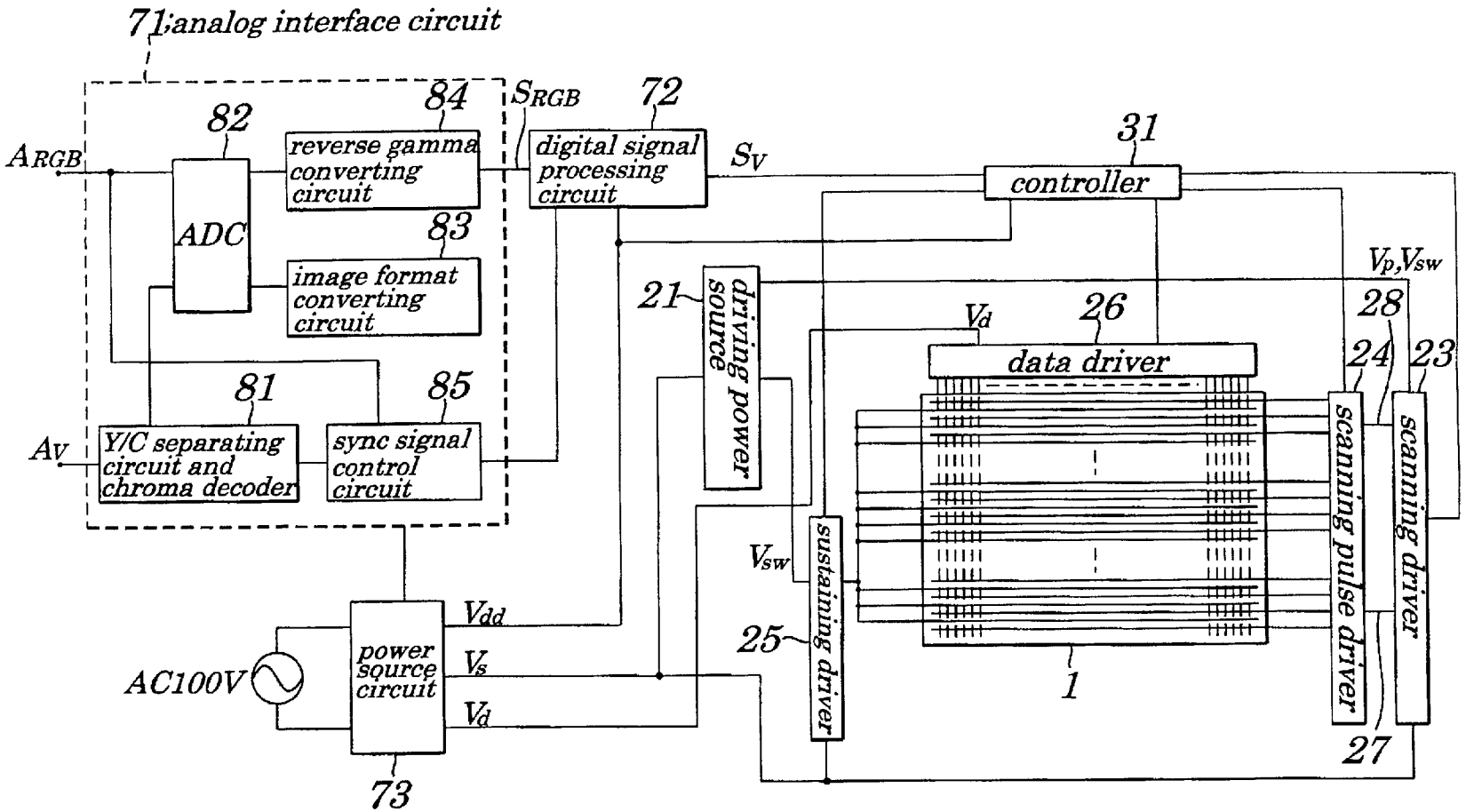
FIG. 13 is a block diagram showing one example of configurations of a plasma display device employing the driving circuit of the PDP of the present invention.
Figure 14:
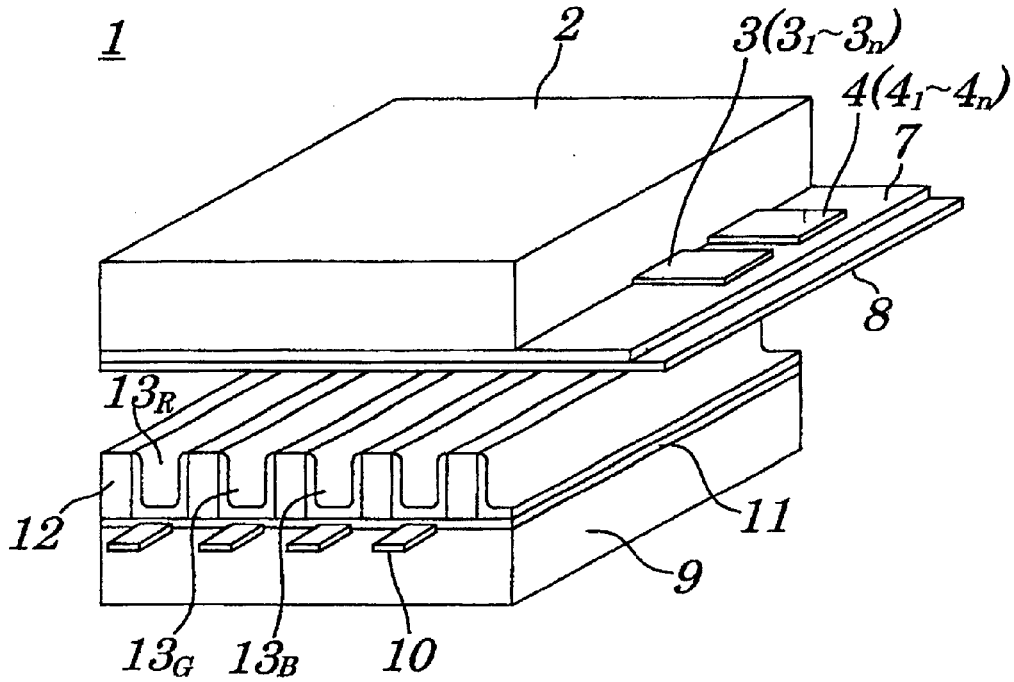
FIG. 14 (PRIOR ART)
FIG. 14 is a schematic exploded perspective view showing configurations of a conventional AC driving surface-discharge type PDP.
Figure 15:
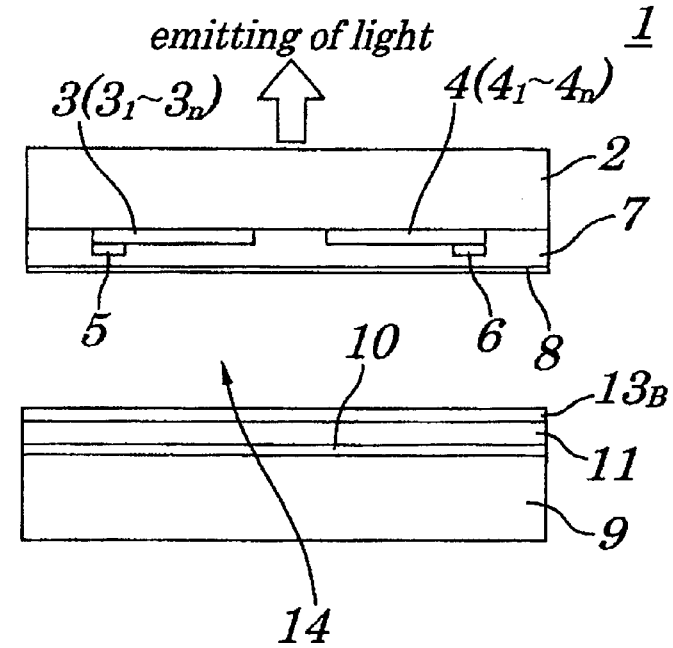
FIG. 15 (PRIOR ART)
FIG. 15 is an enlarged cross-sectional view showing one display cell of the conventional AC driving surface-discharge type PDP.

Also, the driving circuit of the PDP 1 of the present invention may be applied to a plasma display device having the PDP 1 used in monitors for a display of televisions, computers, or a like. FIG. 13 is a block diagram showing one example of configurations of a plasma display device employing the driving circuit of the PDP 1 of the present invention. In FIG. 13, same reference numbers are assigned to corresponding parts having same functions as those in FIG. 1 and their descriptions are omitted accordingly. The plasma display device shown in FIG. 13 includes an analog interface circuit 71 mounted on a front stage of the PDP 1 and its driving circuit shown in FIG. 1, a digital signal processing circuit 72 and a power source circuit 73 used to supply a direct current to each of components from an AC 100 Volts source. The analog interface circuit 71 includes a Y/C separating circuit and chroma decoder 81, an analog digital converter (ADC) 82, an image format converting circuit 83, a reverse gamma converting circuit 84, and a sync signal control circuit 85. The Y/C separating circuit and chroma decoder 81, when this plasma display device is used as a display section of a television, separates an analog video signal $A_v$ into luminance signals of each of red (R), green (G), and blue (B) colors. The ADC 82, when the plasma display device is used as a monitor of computers or a like, converts analog RGB color signals $A_{RGB}$ into digital RGB color signals and, when the plasma display device is used as a display section of the television, converts analog luminance signals of each of red (R), green (G), and blue (B) colors to be fed from the Y/C separating circuit and chroma decoder 81 into digital luminance signals of each of red (R), green (G), and blue (B) color signals. The image format converting circuit 83, when pixel configurations of the PDP 1 are different from pixel configurations of luminance signals of each of the R, G, and B colors to be fed from the ADC 82, converts digital pixel configurations of each of the R, G, and B colors so that the pixel configurations of luminance signals of each of the R, G, and B colors can match the pixel configuration of the PDP 1. The reverse gamma converting circuit 84 makes reverse gamma correction to characteristics of digital luminance signals of each of the R, G, and B colors fed from the image format converting circuit 83 or to digital RGB color signals to which gamma correction was made so that the digital RGB color signals can match the gamma characteristic of a CRT display so as to match linear gamma characteristics of the PDP 1. The sync signal control circuit 85, based on a horizontal sync signal to be fed, together with the analog video signal $A_v$, produces a sampling clock and data clock of the ADC 82. Moreover, in the conventional technology and the above first to fourth embodiments, the driving power source 21 or the like produces the logic voltage $V_{dd}$, data voltage $V_d$, sustaining voltage $V_s$ and, at the same time, based on the sustaining voltage $V_s$ and the priming voltage $V_p$. However, in actual plasma display devices, the power source circuit 73 produces the logic voltage $V_{dd}$, data voltage $v_d$, and sustaining voltage $V_s$ and driving power source 21 or the like, based on the sustaining voltage $V_s$ to be fed from the power source circuit 73, the priming voltage $V_p$ or the like. FIG. 13 indicates this. Moreover, the PDP 1, controller 31, driving power source 21, scanning driver 23, scanning pulse driver 24, sustaining driver 25, data driver 26 and digital signal processing circuit 72 are designed in modules. In the above example, the driving circuit of the PDP 1 shown in FIG. 1 is used in the plasma display device, however, the driving circuit of the PDP 1 shown in FIGS. 5, 7, and 10 may be also used.

What is claimed is:

1. A method for driving a plasma display panel, said plasma display panel including a plurality of pairs of surface discharge electrodes each said pair of said surface discharge electrodes being made up of a scanning electrode and a sustaining electrode and each said scanning electrode and said sustaining electrode being formed successively in a column direction and being parallel to a row direction and a plurality of data electrodes each being formed successively in the row direction and being parallel to said column direction, forming pixels at intersections of said plurality of said data electrodes and said plurality of said pairs of surface discharge electrodes, and discharge space existing in a gap between a plane on which said plurality of said pairs of said surface discharge electrodes is formed and a plane on which said plurality of said data electrodes is formed, comprising:

a step of applying, immediately after power is turned ON, a pulse having an erasing pulse which causes a maximum potential difference between said sustaining electrode and said scanning electrode being adjacent to each other to reach at least a sustaining voltage, to said scanning electrode.

2. The method for driving the plasma display panel according to claim 1, wherein, after said power is said turned ON, said pulse having said erasing pulse is applied repeatedly to said scanning electrode until said sustaining voltage reaches a predetermined voltage value.

3. The method for driving the plasma display panel according to claim 1, wherein, after said power is said turned ON, said pulse having said erasing pulse is applied to said scanning electrode repeatedly for a predetermined time.

4. The method for driving the plasma display panel according to claim 1, wherein, said pulse having said erasing pulse and being applied to said scanning electrode has a priming period, address period, and sustaining period; and wherein said erasing pulse is produced during said priming period.

5. The method for driving the plasma display panel according to claim 1, wherein, said pulse having said erasing pulse and being applied to said scanning electrode has a first priming period, second priming period, address period, and sustaining period, and wherein said erasing pulse is fed during said first priming period and is made up of a priming pulse which causes a maximum potential difference between said scanning electrode and said sustaining electrode being adjacent to said each other to reach at least priming voltage in order to cause priming discharge to occur during said second priming period and of a second erasing pulse used to reduce wall charges accumulated both on said scanning electrode and said sustaining electrode being adjacent to said each other caused by said priming discharge.

6. The method for driving the plasma display panel according to claim 1, wherein, after said pulse having said erasing pulse has been applied, a pulse having a priming period and address period and having a writing scanning pulse which causes a potential difference between said scanning electrode and said sustaining electrode being adjacent to said each other during said address period to become a sustaining voltage, is applied during said address period to said scanning electrode.

7. A circuit for driving a plasma display panel, said plasma display panel having a plurality of pairs of surface discharge electrodes each said pair of said surface discharge electrodes being made up of a scanning electrode and a sustaining electrode and each said scanning electrode and said sustaining electrode being formed successively in a column direction and being parallel to a row direction and a plurality of data electrodes each being formed successively in said row direction and being parallel to said column direction, forming pixels at intersections of said plurality of said data electrodes and said plurality of said pairs of said surface discharge electrodes, and discharge space existing in a gap between a plane on which said plurality of said pairs of surface discharge electrodes is formed and a plane on which said plurality of said data electrodes is formed, comprising:

a controller to produce, immediately after power is turned ON, a control signal used to apply a pulse having an erasing pulse which causes a maximum potential difference between said sustaining electrode and said scanning electrode being adjacent to each other to reach at least a sustaining voltage, to said scanning electrode.

8. The circuit for driving the plasma display panel according to claim 7, further comprising:

a voltage detection circuit to detect, after said power is turned ON, said sustaining voltage which has reached a predetermined voltage; and wherein said controller produces said control signal repeatedly until said voltage detection circuit detects said sustaining voltage that has reached a predetermined voltage value.

9. The circuit for driving the plasma display panel according to claim 7, further comprising a timer to measure predetermined time after said power is turned ON and wherein said controller produces said control signal repeatedly until said timer has measured said predetermined time.

10. The circuit for driving the plasma display panel according to claim 7, wherein said pulse having said erasing pulse and applied to said scanning electrode has a priming period, address period, and sustaining period; and wherein said erasing pulse is produced in said priming period.

11. The circuit for driving the plasma display panel according to claim 7, wherein, said pulse having said erasing pulse and being applied to said scanning electrode has a first priming period, second priming period, address period, and sustaining period, and wherein said erasing pulse is fed during said first priming period and is made up of a priming pulse which causes a maximum potential difference between said scanning electrode and said sustaining electrode being adjacent to said each other to reach at least a priming voltage in order to cause priming discharge to occur during said second priming period and of a second erasing pulse used to reduce wall charges on said scanning electrode and said sustaining electrode being adjacent to said each other caused by said priming discharge.

12. The circuit for driving the plasma display panel according to claim 7, wherein said controller, after applying said pulse having said erasing pulse, produces a control signal having a priming period and address period and writing scanning pulse to cause a potential difference between said scanning electrode and said sustaining electrode being adjacent to said each other to become a sustaining voltage during said address period.

13. A plasma display device including a circuit for driving a plasma display panel, said plasma display panel having a plurality of pairs of surface discharge electrodes each said pair of said surface discharge electrodes being made up of a scanning electrode and a sustaining electrode and each said scanning electrode and said sustaining electrode being formed successively in a column direction and being parallel to a row direction and a plurality of data electrodes each being formed successively in said row direction and being parallel to said column direction, forming pixels at intersections of said plurality of said data electrodes and said plurality of said pairs of said surface discharge electrodes, and discharge space existing in a gap between a plane on which said plurality of said pairs of surface discharge electrodes is formed and a plane on which said plurality of said data electrodes is formed, comprising:

a controller to produce, immediately after power is turned ON, a control signal used to apply a pulse having an erasing pulse which causes a maximum potential difference between said sustaining electrode and said scanning electrode being adjacent to each other to reach at least a sustaining voltage, to said scanning electrode.

14. The plasma display device including the circuit for driving the plasma display panel according to claim 13, said circuit further comprising:

a voltage detection circuit to detect, after said power is turned ON, said sustaining voltage which has reached a predetermined voltage; and wherein said controller produces said control signal repeatedly until said voltage detection circuit detects said sustaining voltage that has reached a predetermined voltage value.

15. The plasma display device including the circuit for driving the plasma display panel according to claim 13, said circuit further comprising: a timer to measure predetermined time after said power is turned ON and wherein said controller produces said control signal repeatedly until said timer has measured said predetermined time.

16. The plasma display device including the circuit for driving the plasma display panel according to claim 13, wherein said pulse having said erasing pulse and applied to said scanning electrode has a priming period, address period, and sustaining period; and wherein said erasing pulse is produced in said priming period.

17. The plasma display device including the circuit for driving the plasma display panel according to claim 13 wherein, said pulse having said erasing pulse and being applied to said scanning electrode has a first priming period, second priming period, address period, and sustaining period, and wherein said erasing pulse is fed during said first priming period and is made up of a priming pulse which causes a maximum potential difference between said scanning electrode and said sustaining electrode being adjacent to said each other to reach at least a priming voltage in order to cause priming discharge to occur during said second priming period and of a second erasing pulse used to reduce wall charges on said scanning electrode and said sustaining electrode being adjacent to said each other caused by said priming discharge.

18. The plasma display device including the circuit for driving the plasma display panel according to claim 13, wherein said controller, after applying said pulse having said erasing pulse, produces a control signal having a priming period and address period and writing scanning pulse to cause a potential difference between said scanning electrode and said sustaining electrode being adjacent to said each other to become a sustaining voltage during said address period.

* * * * *

UNITED STATES PATENT AND TRADEMARK OFFICE

CERTIFICATE OF CORRECTION

PATENT NO. : 6,642,663 B2
DATED : November 4, 2003
INVENTOR(S) : Teruo Okamura et al.

It is certified that error appears in the above-identified patent and that said Letters Patent is hereby corrected as shown below:

Column 1,
Line 48, after "$4(4_1=4_n)$" insert -- . --;

Column 2,
Line 57, delete "$S_{SPDin}$" and insert -- $S_{SPD1n}$ --;
Line 62, delete "$S_{SPD2}$" and insert -- $S_{SPD2n}$ --;

Column 4,
Line 65, delete "$P_{sck}$" and insert -- $P_{SCk}$ --;

Column 5,
Line 26, delete "$S_{SU3}$" and insert --$S_{SUD3}$ --;

Column 6,
Line 21, delete "$P_{sc1}$" and insert -- $P_{SC1}$ --;
Line 44, delete "$S_{SPDin}$" and insert -- $S_{SPD1n}$ --;

Column 8,
Line 1, delete "$S_{DD1M}$" and insert -- $S_{DD1m}$ --;
Line 38, after "$4(4_1\text{-}4_n)$" insert -- . --;

Column 13,
Line 65, delete "$S_{scD2}$" and insert -- $S_{SCD2}$ --;

Column 15,
Line 33, delete "electrode $3_b$" and insert -- electrode $3_k$ --;

Column 17,
Line 7, delete "$S_{SPD2n}$ to $S_{SPD2n}$" and insert -- $S_{SPD21}$ to $S_{SPD2n}$ --;

Column 19,
Line 48, delete "$3_1$ to $3_u$" and insert -- $3_1$ to $3_n$ --;

Column 21,
Line 43 delete "Ve" and insert -- $V_e$ --;

UNITED STATES PATENT AND TRADEMARK OFFICE

CERTIFICATE OF CORRECTION

PATENT NO. : 6,642,663 B2
DATED : November 4, 2003
INVENTOR(S) : Teruo Okamura et al.

It is certified that error appears in the above-identified patent and that said Letters Patent is hereby corrected as shown below:

Column 23,
Lines 8, 22 and 43, delete "V," and insert -- $V_s$ --;
Line 28, delete "time to" and insert -- time $t_o$ --;

Column 24,
Line 41, delete "driver.23" and insert -- driver 23 --;

Signed and Sealed this

Twenty-eighth Day of December, 2004

JON W. DUDAS
*Director of the United States Patent and Trademark Office*